US010857416B2

(12) United States Patent
Leipheimer

(10) Patent No.: US 10,857,416 B2
(45) Date of Patent: Dec. 8, 2020

(54) MULTIPLE HAND ANGLE CABLE ATTACHMENT

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 0 days.

(21) Appl. No.: 16/284,389

(22) Filed: Feb. 25, 2019

(65) Prior Publication Data

US 2019/0184226 A1 Jun. 20, 2019

Related U.S. Application Data

(63) Continuation-in-part of application No. PCT/US2018/063820, filed on Dec. 4, 2018.

(60) Provisional application No. 62/594,301, filed on Dec. 4, 2017.

(51) Int. Cl.
*A63B 21/00* (2006.01)
*A63B 22/00* (2006.01)

(52) U.S. Cl.
CPC ..... *A63B 21/4035* (2015.10); *A63B 21/152* (2013.01); *A63B 21/4039* (2015.10); *A63B 2022/0082* (2013.01); *A63B 2225/09* (2013.01)

(58) Field of Classification Search
CPC ..... A63B 21/4035; A63B 21/4039; A63B 21/152; A63B 2225/09; A63B 23/12; A63B 21/06; A63B 2022/0079–0084; A63B 2069/062–066
See application file for complete search history.

(56) References Cited

U.S. PATENT DOCUMENTS 3,516,661 A * 6/1970 Hansen ..... A63B 21/015 482/115
4,618,143 A 10/1986 Twardosz
RE33,218 E 5/1990 Twardosz
5,080,349 A 1/1992 Vittone
5,167,596 A * 12/1992 Ferber ..... A63B 21/0004 482/114

(Continued)

FOREIGN PATENT DOCUMENTS

CN 2774932 Y 4/2006
KR 20110011844 U 12/2011

OTHER PUBLICATIONS

GRYPIT, "Better by Design", https://www.grypit.com/, accessed Apr. 18, 2019.

(Continued)

*Primary Examiner* — Nyca T Nguyen
(74) *Attorney, Agent, or Firm* — The Webb Law Firm

(57) ABSTRACT

A cable attachment handle for an exercise machine including a main mounting body defining a horizontal axis, a first stud extending from the main mounting body, a first handle mount rotatable about the first stud, a first handle extending from the first handle mount, a second stud extending from the main mounting body, a second handle mount rotatable about the second stud, a second handle extending from the second handle mount, and a cable attachment element affixed to the main mounting body between the first stud and the second stud.

18 Claims, 16 Drawing Sheets

(56) References Cited

U.S. PATENT DOCUMENTS 5,265,969 A * 11/1993 Chuang ..... A45B 17/00 16/329
5,273,509 A * 12/1993 Vittone ..... A63B 21/06 482/101
5,334,113 A 8/1994 Roepke
5,399,133 A 3/1995 Haber et al.
5,588,942 A * 12/1996 Dillard ..... A63B 21/4035 482/106
5,761,767 A 6/1998 Barton
5,921,902 A * 7/1999 Carpenter ..... A63B 21/154 482/139
6,663,542 B1 * 12/2003 Trabbic ..... A63B 21/0724 482/106
7,066,866 B1 * 6/2006 Mobley ..... A63B 1/00 482/40
7,837,598 B1 * 11/2010 Boozel, Jr. ..... A63B 21/151 482/38
8,057,368 B1 * 11/2011 Lyszczarz ..... A63B 21/156 482/103
8,147,391 B1 * 4/2012 Hill ..... A63B 21/4035 482/132
8,915,828 B1 * 12/2014 Stalnaker ..... A63B 21/00185 482/117
8,944,978 B2 * 2/2015 Kristiansen ..... A63B 71/00 482/121
9,808,665 B1 * 11/2017 Demarais ..... A63B 21/4035
9,833,654 B1 * 12/2017 Gant ..... A63B 21/0724
2006/0252613 A1 * 11/2006 Barnes ..... A63B 21/00072 482/95
2007/0123398 A1 * 5/2007 Ljevaja ..... A63B 15/00 482/107
2007/0135281 A1 * 6/2007 Liao ..... A63B 21/4047 482/140
2007/0243977 A1 10/2007 Zeien
2009/0253559 A1 * 10/2009 Maresh ..... A63B 21/00072 482/93
2010/0009816 A1 * 1/2010 Edmondson ..... A63B 22/0046 482/72
2010/0113234 A1 * 5/2010 Kristiansen ..... A63B 21/151 482/139
2011/0218085 A1 9/2011 Kristiansen
2015/0038300 A1 * 2/2015 Forhan ..... A63B 21/00047 482/72
2015/0182780 A1 * 7/2015 Olson ..... A63B 21/156 482/139
2016/0051857 A1 * 2/2016 Rasner ..... A63B 21/4035 482/92
2016/0213968 A1 * 7/2016 Boss ..... A63B 21/16
2017/0157457 A1 6/2017 Kurabieski et al.
2018/0207473 A1 * 7/2018 McCullough ..... A63B 21/4035

OTHER PUBLICATIONS

GRYPIT, "Biceps Bar", https://www.grypit.com/, accessed Apr. 18, 2019.
GRYPIT, "Biceps Bar Narrow Grip", https://www.grypit.com/, accessed Apr. 18, 2019.
GRYPIT, "Triceps Bar" https://www.grypit.com/ accessed Apr. 19, 2019.
GRYPIT, "Why GRYPiT Handles?", https://www.grypit.com/, accessed Apr. 18, 2019.
MAG Maxium Advantage Grip, Products., http://web.archive.org/web/20171029102024/http://maxagrip.com/products.html.
Prime Fitness, "PRIME RO-T8 Handles: 4N1 vs 3N1 w/Coach Kassem @ N1 Education", Jul. 23, 2018, YouTube, https://youtu.be/ZcqHCI9ljkXo, accessed Apr. 4, 2019.

* cited by examiner

MULTIPLE HAND ANGLE CABLE ATTACHMENT

CROSS-REFERENCE TO RELATED APPLICATIONS

This application is a United States continuation-in-part application of International Application No. PCT/US2018/063820 filed Dec. 4, 2018, which claims the benefit of U.S. Provisional Patent Application No. 62/594,301 filed Dec. 4, 2017, the disclosure of each of which is hereby incorporated by reference in its entirety.

BACKGROUND OF THE INVENTION

Field of the Invention

This disclosure relates generally to attachment handles for exercise or weight machines and, more particularly, to adjustable attachment handles for cable exercise machines that allow a user to vary his or her hand position for performing an exercise movement.

Description of Related Art

Exercise machines which employ a cable attached to a counterweight or other resistive element are well known. Conventionally, such exercise machines include a handle fixed or removably attached to an end of the cable. The handle may be, for example, a D-handle, barbell, or rope handle. A user must exert a force on the handle to overcome the resistance of the resistive element and move the cable through a predetermined range of motion.

When performing pulling movements, a user's grip position may have a significant impact on which muscles are activated and the percentage of those muscles which are activated. Three main categories of grip positions for performing pulling movements are neutral grip position, in which the user's palms face each other; supinated grip position, in which the user's palms face up; and pronated grip position, in which the user's palms face down. The neutral grip position significantly activates the brachioradialis muscle, the supinated grip position significantly activates the biceps brachii muscle, and the pronated grip position significantly activates the brachialis muscle. Adjusting between these various grip positions allows the user to alter which muscles are activated by an exercise movement and to optimize the activation of those muscles.

Many conventional exercise machines use a fixed position handle that provides only one grip position. To change grip positions, the user must replace the handle with a different handle configured for the desired grip position. Examples of various exercise handles having different but fixed grip positions are described in U.S. Pat. No. 5,761,767 to Barton. Barton also describes a handle having a wing against which the user's palm rests when performing a pulling movement. Such wings may result in a 10% to 20% increase in pulling force as the load of the exercise machine is transferred from the user's fingers to the user's palms. However, Barton suffers from the deficiency described above in that the user must replace the handle in order to change grip positions.

U.S. Pat. No. 5,334,113 to Roepke and U.S. Patent Application Publication No. 2007/0243977 to Zeien describe exercise handles which are rotatable and thus support multiple grip positions. However, the handles described in Roepke and Zeien are not lockable into a fixed position and, as such, the user must actively maintain the desired grip position throughout the exercise movement. This is undesirable, as the muscle activation used to maintain the grip position may reduce the amount of strength available to perform the desired exercise movement. Additionally, the user may be required to reduce the amount of resistance of the exercise machine in order to maintain the desired grip position.

U.S. Pat. No. 5,399,133 to Haber et al. ("Haber") describes an adjustable handle rotatable about three axes via two yokes. The yokes may be tightened into a set position using tightening knobs. However, the tightening knobs rely on friction to lock the yokes into the set position. As such, the application of too much force to the handle will cause the yokes to move from the set position. Additionally, Haber relies on the user's knowledge of the appropriate position at which to tighten the knobs. Still further, the handle of Haber is intended for attachment to a permanent structure of the exercise machine, rather than attachment to a cable.

U.S. Pat. No. 4,618,143 to Twardosz describes a handle having concentric rings rotatable between several positions. The rings may be locked relative to one another using a screw and nut. However, adjustment of the handle of Twardosz is cumbersome and time consuming as it requires removal of the screw and nut.

There exists a need for a handle for cable exercise machines which is easily and quickly adjustable between various grip positions to reduce downtime and eliminate the need for multiple fixed position handles.

SUMMARY OF THE INVENTION

Non-limiting embodiments of the present invention are directed to a cable attachment handle for an exercise machine including a main mounting body defining a horizontal axis, a first stud extending from the main mounting body, a first handle mount rotatable about the first stud, a first handle extending from the first handle mount, a second stud extending from the main mounting body, a second handle mount rotatable about the second stud, a second handle extending from the second handle mount, and a cable attachment element affixed to the main mounting body between the first stud and the second stud.

In some non-limiting embodiments, the first handle extends substantially perpendicular to the first stud, and wherein the second handle extends substantially perpendicular to the second stud.

In some non-limiting embodiments, the cable attachment handle further includes a first alignment pin extending from the main mounting body and configured to removably engage any of a plurality of alignment holes in the first handle mount, and a second alignment pin extending from the main mounting body and configured to removably engage any of a plurality of alignment holes in the second handle mount. Engagement of the first alignment pin with any of the plurality of alignment holes in the first handle mount prevents rotation of the first handle mount relative to the main mounting body. Engagement of the second alignment pin with any of the plurality of alignment holes in the second handle mount prevents rotation of the second handle mount relative to the main mounting body.

In some non-limiting embodiments, the first handle and the second handle are adjustable between an at least partially supinated position in which the first alignment pin is engaged with a first of the plurality of alignment holes in the first handle mount and the second alignment pin is engaged with a first of the plurality of alignment holes in the second handle mount, a neutral position in which the first alignment pin is engaged with a second of the plurality of alignment holes in the first handle mount and the second alignment pin is engaged with a second of the plurality of alignment holes in the second handle mount, and an at least partially pronated position in which the first alignment pin is engaged with a third of the plurality of alignment holes in the first handle mount and the second alignment pin is engaged with a third of the plurality of alignment holes in the second handle mount.

In some non-limiting embodiments, the first handle and the second handle are further adjustable between a fully pronated position in which the first alignment pin is engaged with a fourth of the plurality of alignment holes in the first handle mount and the second alignment pin is engaged with a fourth of the plurality of alignment holes in the second handle mount.

In some non-limiting embodiments, the cable attachment handle further includes a first alignment pin extending from the first handle mount and configured to removably engage any of a first plurality of alignment holes in the main mounting body, and a second alignment pin extending from the second handle mount and configured to removably engage any of a second plurality of alignment holes in the main mounting body. Engagement of the first alignment pin with any of the first plurality of alignment holes prevents rotation of the first handle mount relative to the main mounting body. Engagement of the second alignment pin with any of the second plurality of alignment holes prevents rotation of the second handle mount relative to the main mounting body.

In some non-limiting embodiments, the first handle and the second handle are adjustable between a supinated position in which the first alignment pin is engaged with a first of the first plurality of alignment holes in the main mounting body and the second alignment pin is engaged with a first of the second plurality of alignment holes in the main mounting body, a neutral position in which the first alignment pin is engaged with a second of the first plurality of alignment holes in the main mounting body and the second alignment pin is engaged with a second of the second plurality of alignment holes in the main mounting body, and a pronated position in which the first alignment pin is engaged with a third of the first plurality of alignment holes in the main mounting body and the second alignment pin is engaged with a third of the second plurality of alignment holes in the main mounting body.

In some non-limiting embodiments, the first handle and the second handle are further adjustable between a fully pronated position in which the first alignment pin is engaged with a fourth of the plurality of alignment holes in the first handle mount and the second alignment pin is engaged with a fourth of the plurality of alignment holes in the second handle mount.

In some non-limiting embodiments, the first handle is removably attached to the first handle mount, and the second handle is removably attached to the second handle mount.

In some non-limiting embodiments, each of the first handle and the second handle include a post having a longitudinal axis, and a paddle extending from the post along a plane parallel to a longitudinal axis of the post.

In some non-limiting embodiments, the cable attachment handle further includes one or more fasteners securing each of the first and second handles to each of the first and second handle mounts, respectively.

In some non-limiting embodiments, the one or more fasteners includes two or more fasteners spaced apart to prevent rotation of the first and second handles about an axis parallel to the longitudinal axis of the post.

In some non-limiting embodiments, the paddle extends from the post at an angle of between approximately 10° and approximately 30° relative to a paddle axis perpendicular to the horizontal axis of the main mounting body.

In some non-limiting embodiments, each of the first post and the second post are slidable along the horizontal axis of the main mounting body.

In some non-limiting embodiments, each of the first post and the second post are lockable at any of a plurality of locations along the horizontal axis of the main mounting body via a popper pin.

Other non-limiting embodiments of the present invention are direct to a cable attachment handle for an exercise machine including a main mounting body defining a horizontal axis, a first handle mount rotatable relative to the main mounting body, a first handle extending from the first handle mount, a second handle mount rotatable relative to the main mounting body, a second handle extending from the second handle mount, and a cable attachment element affixed to the main mounting body between the first stud and the second stud.

In some non-limiting embodiments, each of the first handle and the second handle includes: a post having a longitudinal axis; and a paddle extending from the post along a plane parallel to a longitudinal axis of the post.

In some non-limiting embodiments, the paddle extends from the post at an angle of between approximately 10° and approximately 30° relative to a paddle axis perpendicular to the horizontal axis of the main mounting body.

In some non-limiting embodiments, the cable attachment handle further includes a first alignment pin extending from the main mounting body and configured to removably engage any of a plurality of alignment holes in the first handle mount, and a second alignment pin extending from the main mounting body and configured to removably engage any of a plurality of alignment holes in the second handle mount. Engagement of the first alignment pin with any of the plurality of alignment holes in the first handle mount prevents rotation of the first handle mount relative to the main mounting body. Engagement of the second alignment pin with any of the plurality of alignment holes in the second handle mount prevents rotation of the second handle mount relative to the main mounting body.

In some non-limiting embodiments, the first handle and the second handle are adjustable between an at least partially supinated position in which the first alignment pin is engaged with a first of the plurality of alignment holes in the first handle mount and the second alignment pin is engaged with a first of the plurality of alignment holes in the second handle mount, a neutral position in which the first alignment pin is engaged with a second of the plurality of alignment holes in the first handle mount and the second alignment pin is engaged with a second of the plurality of alignment holes in the second handle mount, and an at least partially pronated position in which the first alignment pin is engaged with a third of the plurality of alignment holes in the first handle mount and the second alignment pin is engaged with a third of the plurality of alignment holes in the second handle mount.

In some non-limiting embodiments, the first alignment pin is a retracting pin of a popper pin assembly. The popper pin assembly includes a housing rigidly mounted to the first handle mount, and a pull knob connected to the retracting pin and slideable relative to the housing. The pull knob and the retracting pin are biased towards the main mounting body such that, in a relaxed state, the retracting pin extends through the first handle mount and into one of the plurality of alignment holes.

In some non-limiting embodiments, the first alignment pin is a retracting pin of a popper pin assembly. The popper pin assembly includes a housing rigidly mounted to the main mounting body, and a pull knob connected to the retracting pin and slideable relative to the housing. The pull knob and the retracting pin are biased towards the first handle mount such that, in a relaxed state, the retracting pin extends through the first handle mount and into one of the plurality of alignment holes.

Further embodiments of the present invention will now be described in the following numbered clauses:

Clause 1. A cable attachment handle for an exercise machine comprising: a main mounting body defining a horizontal axis; a first stud extending from the main mounting body; a first handle mount rotatable about the first stud; a first handle extending from the first handle mount; a second stud extending from the main mounting body; a second handle mount rotatable about the second stud; a second handle extending from the second handle mount; and a cable attachment element affixed to the main mounting body between the first stud and the second stud.

Clause 2. The cable attachment handle of clause 1, wherein the first handle extends substantially perpendicular to the first stud, and wherein the second handle extends substantially perpendicular to the second stud.

Clause 3. The cable attachment handle of clause 1 or 2, further comprising: a first alignment pin extending from the main mounting body and configured to removably engage any of a plurality of alignment holes in the first handle mount; and a second alignment pin extending from the main mounting body and configured to removably engage any of a plurality of alignment holes in the second handle mount, wherein engagement of the first alignment pin with any of the plurality of alignment holes in the first handle mount prevents rotation of the first handle mount relative to the main mounting body, and wherein engagement of the second alignment pin with any of the plurality of alignment holes in the second handle mount prevents rotation of the second handle mount relative to the main mounting body.

Clause 4. The cable attachment handle of any of clauses 1-3, wherein the first handle and the second handle are adjustable between: an at least partially supinated position in which the first alignment pin is engaged with a first of the plurality of alignment holes in the first handle mount and the second alignment pin is engaged with a first of the plurality of alignment holes in the second handle mount; a neutral position in which the first alignment pin is engaged with a second of the plurality of alignment holes in the first handle mount and the second alignment pin is engaged with a second of the plurality of alignment holes in the second handle mount; and an at least partially pronated position in which the first alignment pin is engaged with a third of the plurality of alignment holes in the first handle mount and the second alignment pin is engaged with a third of the plurality of alignment holes in the second handle mount.

Clause 5. The cable attachment handle of any of clauses 1-4, wherein the first handle and the second handle are further adjustable between: a fully pronated position in which the first alignment pin is engaged with a fourth of the plurality of alignment holes in the first handle mount and the second alignment pin is engaged with a fourth of the plurality of alignment holes in the second handle mount.

Clause 6. The cable attachment handle of any of clauses 1-5, further comprising: a first alignment pin extending from the first handle mount and configured to removably engage any of a first plurality of alignment holes in the main mounting body; and a second alignment pin extending from the second handle mount and configured to removably engage any of a second plurality of alignment holes in the main mounting body, wherein engagement of the first alignment pin with any of the first plurality of alignment holes prevents rotation of the first handle mount relative to the main mounting body, and wherein engagement of the second alignment pin with any of the second plurality of alignment holes prevents rotation of the second handle mount relative to the main mounting body.

Clause 7. The cable attachment handle of any of clauses 1-6, wherein the first handle and the second handle are adjustable between: a supinated position in which the first alignment pin is engaged with a first of the first plurality of alignment holes in the main mounting body and the second alignment pin is engaged with a first of the second plurality of alignment holes in the main mounting body; a neutral position in which the first alignment pin is engaged with a second of the first plurality of alignment holes in the main mounting body and the second alignment pin is engaged with a second of the second plurality of alignment holes in the main mounting body; and a pronated position in which the first alignment pin is engaged with a third of the first plurality of alignment holes in the main mounting body and the second alignment pin is engaged with a third of the second plurality of alignment holes in the main mounting body.

Clause 8. The cable attachment handle of any of clauses 1-7, wherein the first handle and the second handle are further adjustable between: a fully pronated position in which the first alignment pin is engaged with a fourth of the plurality of alignment holes in the first handle mount and the second alignment pin is engaged with a fourth of the plurality of alignment holes in the second handle mount.

Clause 9. The cable attachment handle of any of clauses 1-8, wherein the first handle is removably attached to the first handle mount, and wherein the second handle is removably attached to the second handle mount.

Clause 10. The cable attachment handle of any of clauses 1-9, wherein each of the first handle and the second handle comprise: a post having a longitudinal axis; and a paddle extending from the post along a plane parallel to a longitudinal axis of the post.

Clause 11. The cable attachment handle of any of clauses 1-10, further comprising one or more fasteners securing each of the first and second handles to each of the first and second handle mounts, respectively.

Clause 12. The cable attachment handle of any of clauses 1-11, wherein the one or more fasteners comprises two or more fasteners spaced apart to prevent rotation of the first and second handles about an axis parallel to the longitudinal axis of the post.

Clause 13. The cable attachment handle of any of clauses 1-12, wherein the paddle extends from the post at an angle of between approximately 10° and approximately 30° relative to a paddle axis perpendicular to the horizontal axis of the main mounting body.

Clause 14. The cable attachment handle of any of clauses 1-13, wherein each of the first post and the second post are slidable along the horizontal axis of the main mounting body.

Clause 15. The cable attachment handle of any of clauses 1-14, wherein each of the first post and the second post are lockable at any of a plurality of locations along the horizontal axis of the main mounting body via a popper pin.

Clause 16. A cable attachment handle for an exercise machine comprising: a main mounting body defining a horizontal axis; a first handle mount rotatable relative to the main mounting body; a first handle extending from the first handle mount; a second handle mount rotatable relative to the main mounting body; a second handle extending from the second handle mount; and a cable attachment element affixed to the main mounting body between the first stud and the second stud.

Clause 17. The cable attachment handle of clause 16, wherein each of the first handle and the second handle comprises: a post having a longitudinal axis; and a paddle extending from the post along a plane parallel to a longitudinal axis of the post.

Clause 18. The cable attachment handle of clause 16 or 17, wherein the paddle extends from the post at an angle of between approximately 10° and approximately 30° relative to a paddle axis perpendicular to the horizontal axis of the main mounting body.

Clause 19. The cable attachment handle of any of clauses 16-18, further comprising: a first alignment pin extending from the main mounting body and configured to removably engage any of a plurality of alignment holes in the first handle mount; and a second alignment pin extending from the main mounting body and configured to removably engage any of a plurality of alignment holes in the second handle mount, wherein engagement of the first alignment pin with any of the plurality of alignment holes in the first handle mount prevents rotation of the first handle mount relative to the main mounting body, and wherein engagement of the second alignment pin with any of the plurality of alignment holes in the second handle mount prevents rotation of the second handle mount relative to the main mounting body.

Clause 20. The cable attachment handle of any of clauses 16-19, wherein the first handle and the second handle are adjustable between: an at least partially supinated position in which the first alignment pin is engaged with a first of the plurality of alignment holes in the first handle mount and the second alignment pin is engaged with a first of the plurality of alignment holes in the second handle mount; a neutral position in which the first alignment pin is engaged with a second of the plurality of alignment holes in the first handle mount and the second alignment pin is engaged with a second of the plurality of alignment holes in the second handle mount; and an at least partially pronated position in which the first alignment pin is engaged with a third of the plurality of alignment holes in the first handle mount and the second alignment pin is engaged with a third of the plurality of alignment holes in the second handle mount.

Clause 21. The cable attachment handle of any of clauses 1-14, wherein the first alignment pin is a retracting pin of a popper pin assembly, and wherein the popper pin assembly comprises: a housing rigidly mounted to the first handle mount; and a pull knob connected to the retracting pin and slideable relative to the housing, wherein the pull knob and the retracting pin are biased towards the main mounting body such that, in a relaxed state, the retracting pin extends through the first handle mount and into one of the plurality of alignment holes.

Clause 22. The cable attachment handle of any of clauses 1-14, wherein the first alignment pin is a retracting pin of a popper pin assembly, and wherein the popper pin assembly comprises: a housing rigidly mounted to the main mounting body; and a pull knob connected to the retracting pin and slideable relative to the housing, wherein the pull knob and the retracting pin are biased towards the first handle mount such that, in a relaxed state, the retracting pin extends through the first handle mount and into one of the plurality of alignment holes.

These and other features and characteristics of the multiple hand angle cable attachment will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a", "an", and "the" include plural referents unless the context clearly dictates otherwise.

DESCRIPTION OF THE INVENTION

Figure 1:
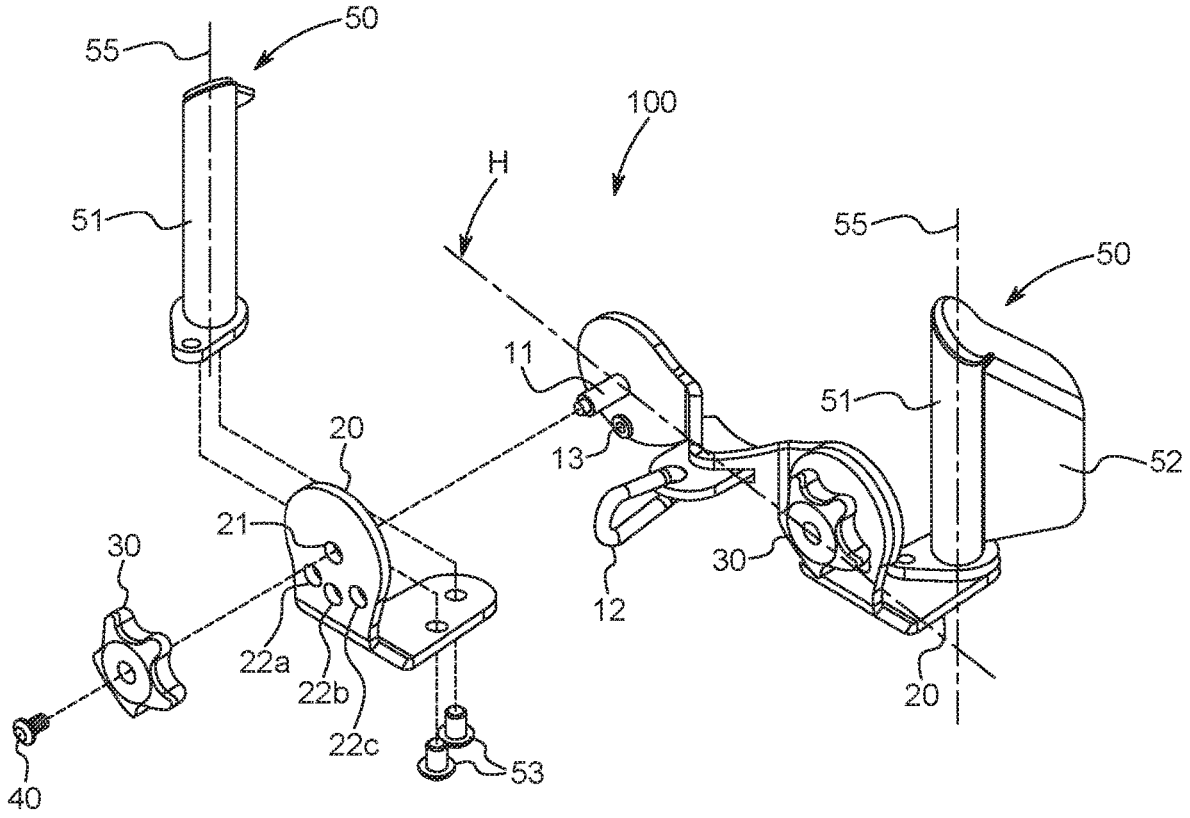
FIG. 1 is an exploded perspective view of a cable attachment handle according to a non-limiting embodiment of the present invention.

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

As used hereinafter, the term "substantially parallel" means within plus or minus 5° of parallel. As used hereinafter, the term "substantially perpendicular" means within plus or minus 5° of perpendicular. As used hereinafter, the term "approximately", when used in reference to a recited angle measurement, means the recited angle measurement plus or minus 5°. For example, "approximately 30°" means "30° plus or minus 5°" or "25° to 35°".

As used hereinafter, the term "supinate" and derivatives thereof mean an arrangement in which a pair of elements are oriented at least partially away from each other in a vertical direction. For example, a first line segment and a second line segment having the same length and occupying the same vertical plane may be referred to as "supinated" if the distance between the base of the first line segment and the base of the second line segment is less than the distance between the top of the first line segment and the top of the second line segment. A person's hand may be referred to as "supinated" if positioned such that the palm of the hand faces at least partially upwardly.

As used hereinafter, the term "pronate" and derivatives thereof mean an arrangement in which a pair of elements are oriented at least partially toward each other in a vertical direction. For example, a first line segment and a second line segment having the same length and occupying the same vertical plane may be referred to as "pronated" if the distance between the base of the first line segment and the base of the second line segment is greater than the distance between the top of the first line segment and the top of the second line segment. A person's hand may be referred to as "pronated" if positioned such that the palm of the hand faces at least partially downwardly.

As used hereinafter, the term "neutral" and derivatives thereof mean an arrangement in which a pair of elements are substantially parallel to each other in a vertical direction. For example, a first line segment and a second line segment occupying the same vertical plane may be referred to as "neutral" if the line segments are substantially parallel to each other. A person's hand may be referred to as "neutral" if positioned such that the palm of the hand faces substantially in a left or right direction.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

The present disclosure relates generally to attachment handles for exercise or weight machines and, more particularly, to adjustable attachment handles for cable exercise machines that allow a user to vary his or her grip position on the handle.

Referring now to FIGS. 1-4, a cable attachment handle 100 adjustable between multiple grip positions is shown in accordance with an embodiment of the present invention. The cable attachment handle 100 includes a main mounting body 10 having a cable attachment element 12 for connecting the cable attachment handle 100 to a cable 300 of an exercise machine. The cable attachment element 12 is located at an approximate midpoint between the two handles 50 to equalize the load on each hand of the user 200 when the user 200 pulls the cable attachment handle 100. The cable attachment element 12 may be a shackle or clip for removable connection of the cable attachment handle 100 and the cable 300. The cable attachment element 12 may also be one of any connection devices known in the art suitable for connection with the cable 300.

The cable attachment handle 100 includes two handle mounts 20 positioned rotatably about respective studs 11 extending from the main mounting body 10. Each of the studs 11 may extend through a hole 21 of the respective handle mount 20, and each of the studs 11 may be threaded such that a torque knob 30 may be fastened onto the stud to secure the handle mount 20 against the main mounting body 10. A stop bolt 40 may be threaded into a tapped hole in the end of each stud 11 to prevent removal of the torque knob 30 from the stud 11. Thus, the torque knob 30 may be rotated by a user 200 to loosen the handle mount 20 from the main mounting body 10 such that the handle mount 20 may be rotated relative to the main mounting body 10. However, due to the presence of the stop bolt 40, the torque knob 30 may not be completely disconnected from the stud 11 during normal operation.

Each handle 50 is attached to or integral with one of the handle mounts 20. Each handle 50 has a post 51 having a longitudinal axis 55 that may be substantially perpendicular to an axis of the respective stud 11. In some embodiments, each handle may include a paddle 52 extending from the post 51 along a plane substantially parallel to the longitudinal axis 55 of the post 51. To use the cable attachment handle 100, the user may wrap one or more fingers of each hand around the respective post 51 and rest the palm of each hand against the respective paddle 52.

In some embodiments, each handle 50 may be removable from the respective handle mount 20 so that the handles 50 may be replaced if damaged or worn out. For example, the handles 50 may have a rubber or foam coating which deteriorates with use, such that periodic replacement of the handles 50 is necessary. In such embodiments, each handle 50 may be secured to the respective handle mount 20 via one or more fasteners 53 such as bolts or screws. The one or more fasteners 53 may include two or more fasteners 53 spaced apart from each other so as to prevent rotation of the handle 50 about an axis parallel to the longitudinal axis 55 of the post 51.

The main mounting body 10 includes one or more alignment pins 13, each corresponding to one of the handle mounts 20. The alignment pin 13 corresponding to each handle mount 20 extends from the main mounting body 10 substantially parallel to the stud 11 corresponding to the same handle mount 20. The alignment pin 13 is configured to engage any one of a plurality of alignment holes 22*a*-22*c* in the corresponding handle mount 20. The plurality of alignment holes 22*a*-22*c* are arranged on the handle mount 20 in an arc having a center point coincident with the corresponding stud 11, such that each of the plurality of alignment holes 22*a*-22*c* are equidistant from the stud 11. Thus, the handle mount 20 may be rotated about the corresponding stud 11 to align any one of the plurality of alignment holes 22*a*-22*c* with the alignment pin 13. Engagement of the alignment pin 13 with any of a plurality of alignment holes 22*a*-22*c* creates a physical obstruction preventing rotation of the handle mount 20 relative to the main mounting body 10.

The plurality of alignment holes 22*a*-22*c* facilitates adjustment of the handles 50 between several positions. To adjust the handle 50 position, the user 200 first unscrews the torque knob 30 such that the handle mount 20 may be separated from the main mounting body 10 along the axis of the stud 11, permitting free rotation of the handle mount 20 relative to the main mounting body 10. Next, the user 200 rotates the handle mount 20 to align the desired one of the plurality of alignment holes 22*a*-22*c* with the alignment pin 13. The handle mount 20 may then be moved toward the main mounting body 10 along the axis of the stud 11, engaging the alignment pin 13 with the desired one of the plurality of alignment holes 22*a*-22*c*. The user 200 may then fasten the torque knob 30 against the handle mount 20, preventing separation of the handle mount 20 from the main mounting body 10.

Figure 2:
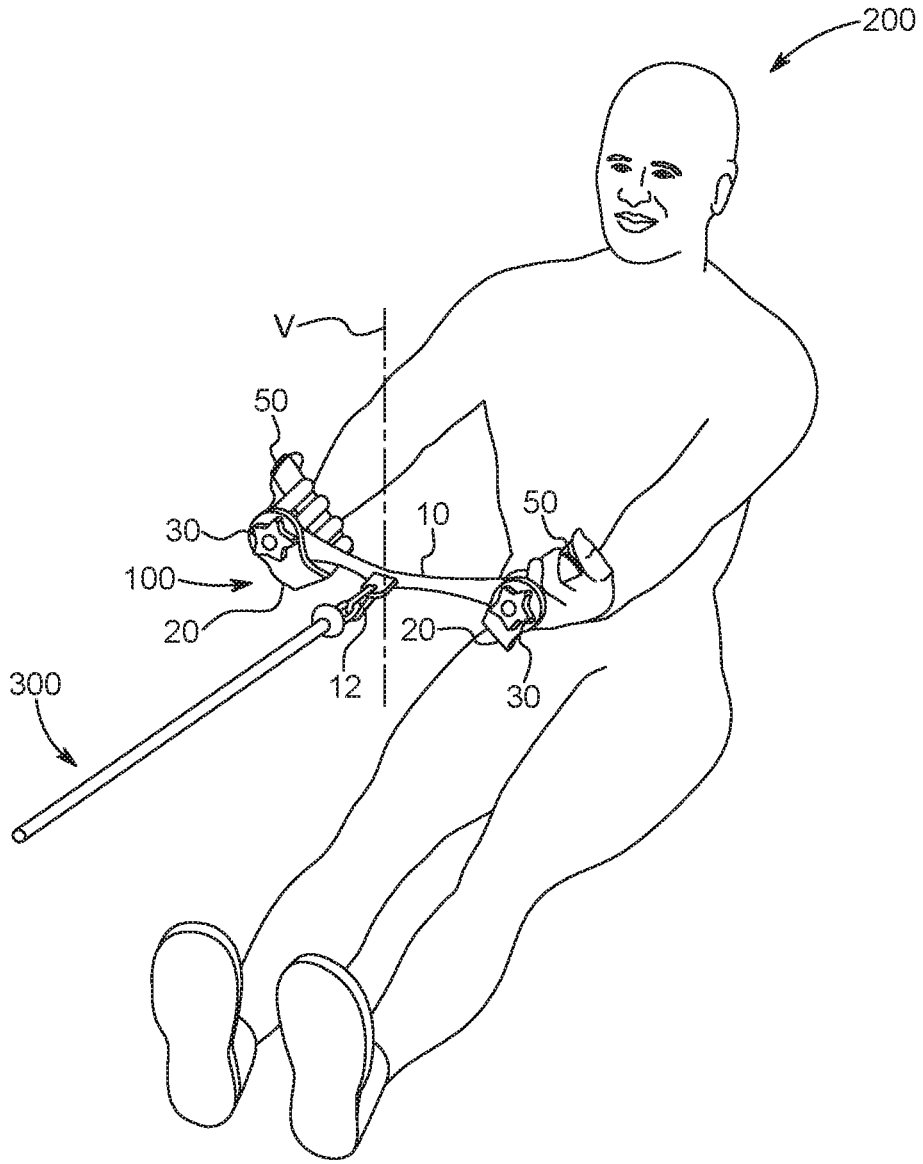
FIG. 2 is a perspective view of a user using the cable attachment handle of FIG. 1 in a supinated grip position.
Figure 3:
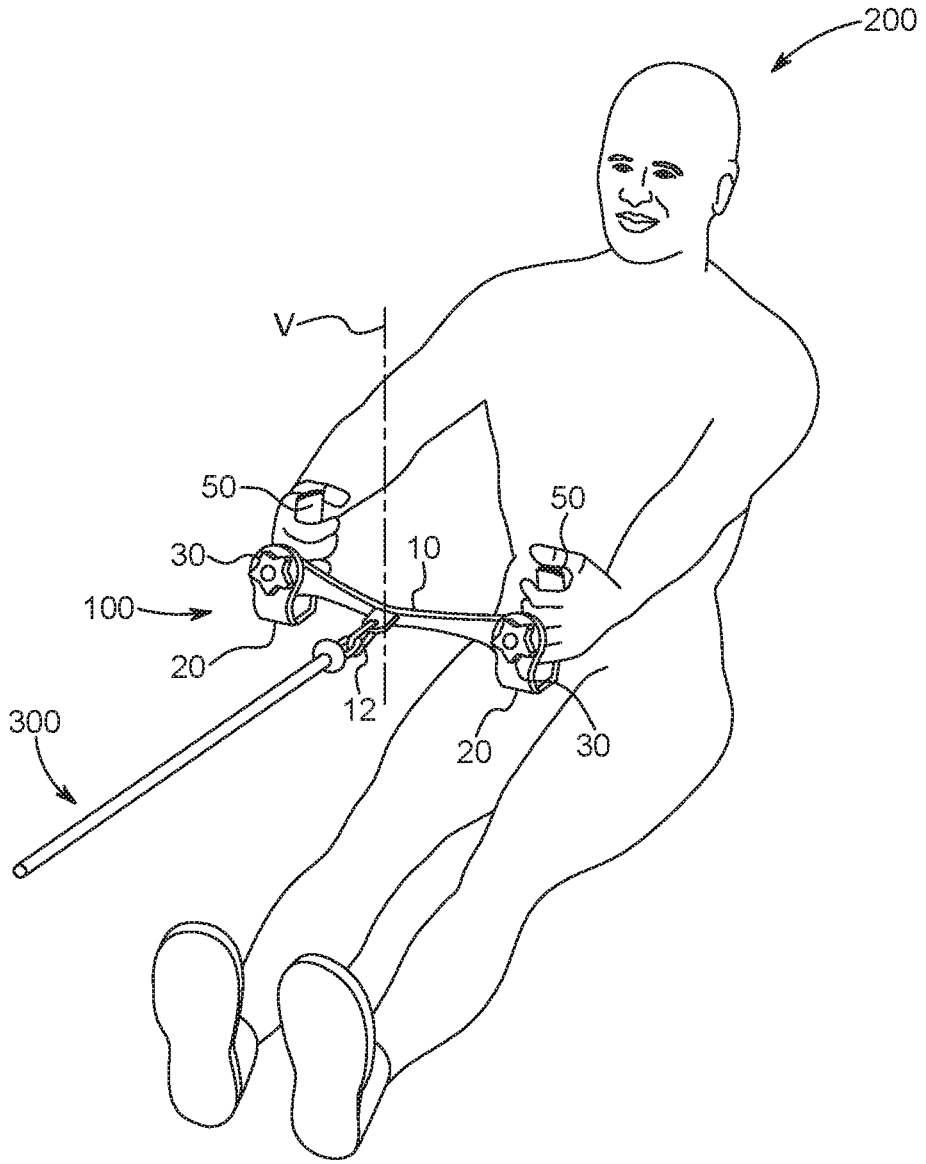
FIG. 3 is a perspective view of a user using the cable attachment handle of FIG. 1 in a neutral grip position.
Figure 4:
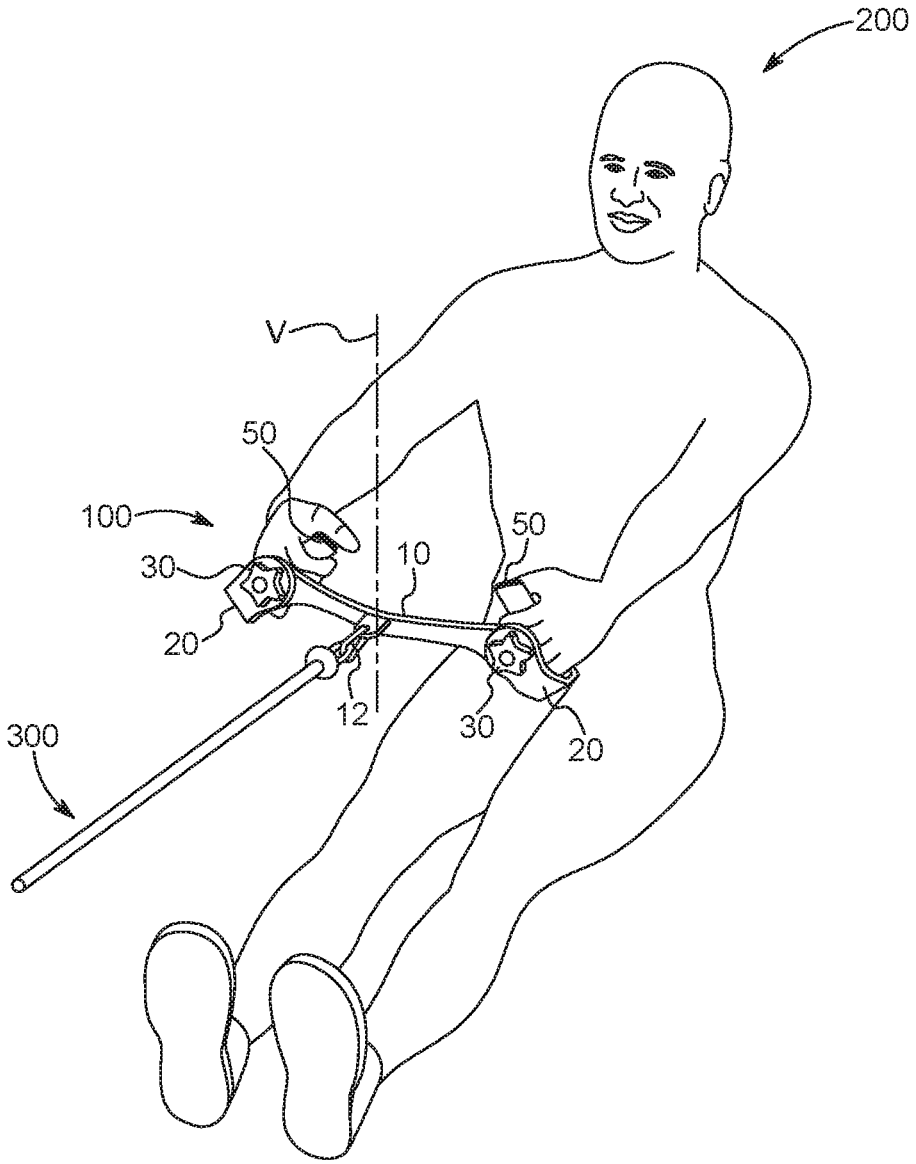
FIG. 4 is a perspective view of a user using the cable attachment handle of FIG. 1 in a pronated grip position.

Referring now to FIGS. 2-4, the user 200 and the cable attachment handle 100 are shown in various grip positions corresponding to each of the plurality of alignment holes 22*a*-22*c*. FIG. 2 illustrates a partially supinated grip position in which the alignment pin 13 is engaged with a first alignment hole 22*a* of the plurality of alignment holes 22*a*-22*c*. In the partially supinated grip position, the handles 50 may be rotated outwardly from a vertical axis V such that the palms of the user 200 face at least partially in an upward direction.

FIG. 3 illustrates a neutral grip position in which the alignment pin 13 is engaged with a second alignment hole 22*b* of the plurality of alignment holes 22*a*-22*c*. In the neutral grip position, the handles 50 may be substantially parallel to a vertical axis V such that the palms of the user 200 face substantially toward each other.

FIG. 4 illustrates a partially pronated grip position in which the alignment pin 13 is engaged with a third alignment hole 22*c* of the plurality of alignment holes 22*a*-22*c*. In the partially pronated grip position, the handles 50 may be rotated inwardly from the vertical axis V such that the palms of the user 200 face at least partially in a downward direction.

As engagement of the alignment pin 13 with the desired one of the plurality of alignment holes 22*a*-22*c* locks the cable attachment handle 100 in any of the supinated, neutral, and pronated grip positions, the user 200 is not required to allocate energy to stabilize the handles 50 or maintain a grip position while performing an exercise movement. As such, the entirety of the force exerted by the user 200 on the cable attachment handle 100 may be directed to the exercise movement, and there is no risk of the user 200 losing the desired plane of motion when performing the exercise movement. Additionally, because the supinated, neutral, and pronated grip positions are defined by the fixed locations of the plurality of alignment holes 22*a*-22*c*, there is no risk of the user 200 improperly orienting the handles 50 of the cable attachment handle 100.

The partially supinated, neutral, and partially pronated grip positions are shown in greater detail in FIGS. 5A-7B. In the partially supinated grip position shown in FIGS. 5A-5B, the handles 50 may be rotated outwardly from the vertical axis V at a supination angle A. To optimize activation of the biceps brachii muscles and comfort through the range of motion of the exercise movement, the supination angle A may be approximately 33°. In the neutral grip position shown in FIGS. 6A-6B, the handles 50 may be substantially parallel to the vertical axis V to optimize activation of the brachioradialis muscles. In the pronated grip position shown in FIGS. 7A-7B, the handles 50 may be rotated inwardly from the vertical axis V at a pronation angle B. To optimize activation of the brachialis muscles and comfort through the range of motion of the exercise movement, the pronation angle B may be approximately 45°. Other values for the supination angle A and the pronation angle B may be selected for comfort of the individual user 200 or to alter the activation of the biceps brachii, brachioradialis, and brachialis muscles as desired.

Figure 5A:
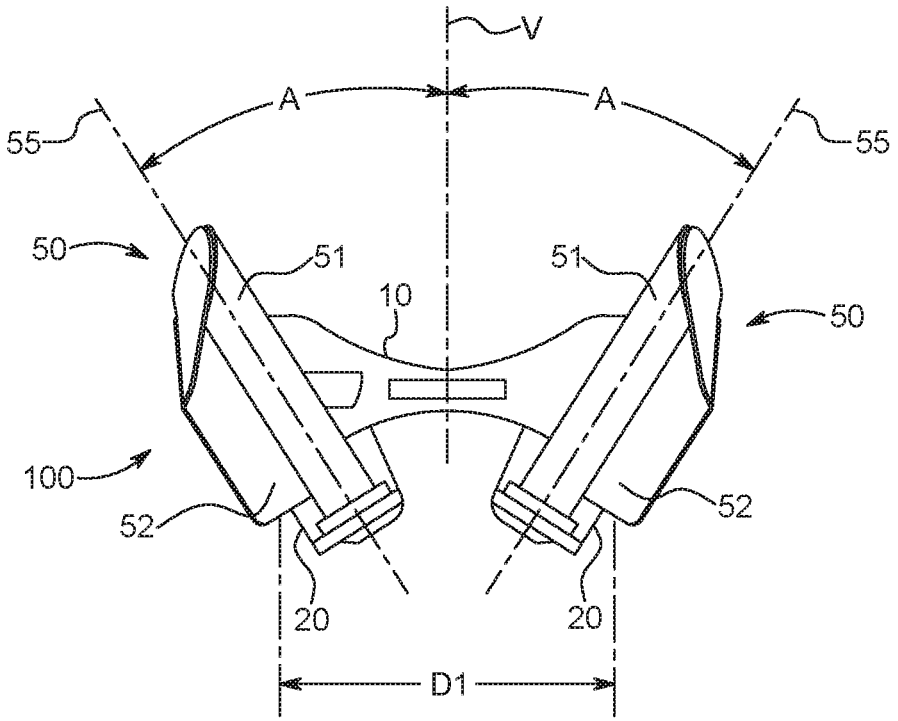
FIGS. 5A-5B are rear views of embodiments of the cable attachment handle of FIG. 1 in a partially supinated grip position.
Figure 5B:
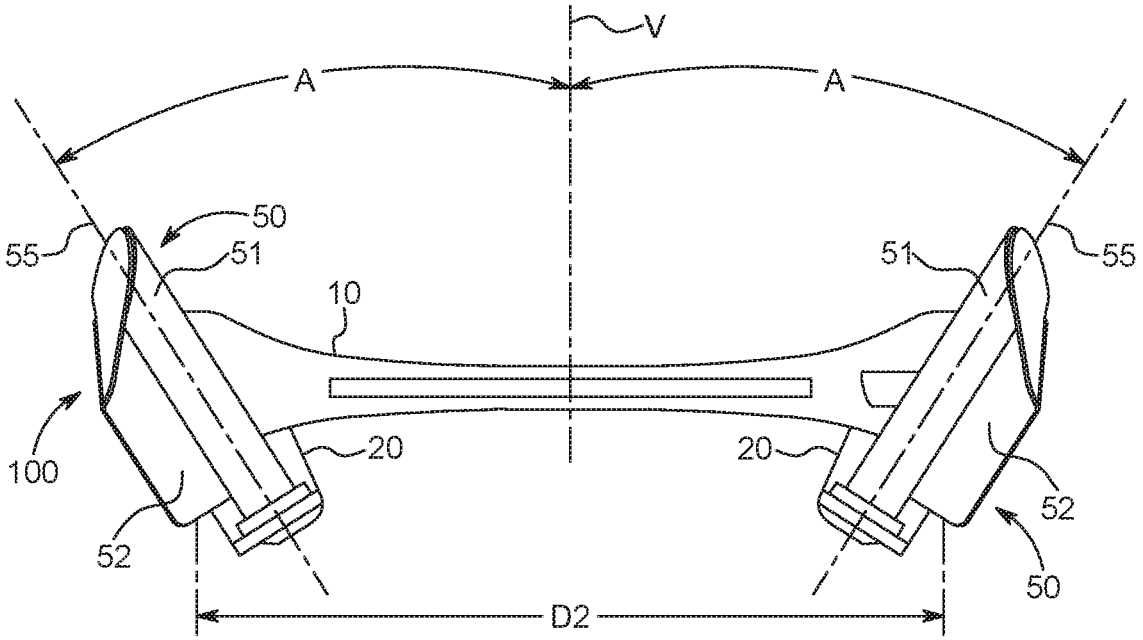
Figure 6A:
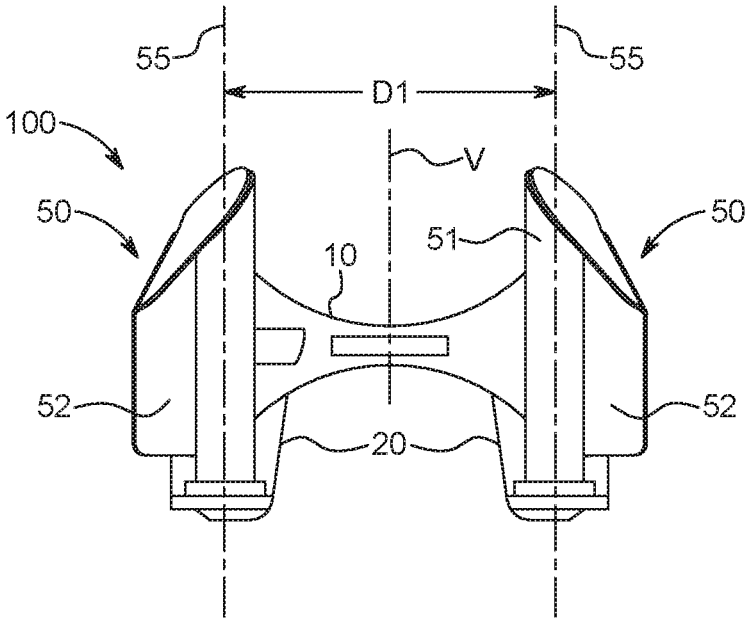
FIGS. 6A-6B are rear views of embodiments of the cable attachment handle of FIG. 1 in a neutral grip position.
Figure 6B:
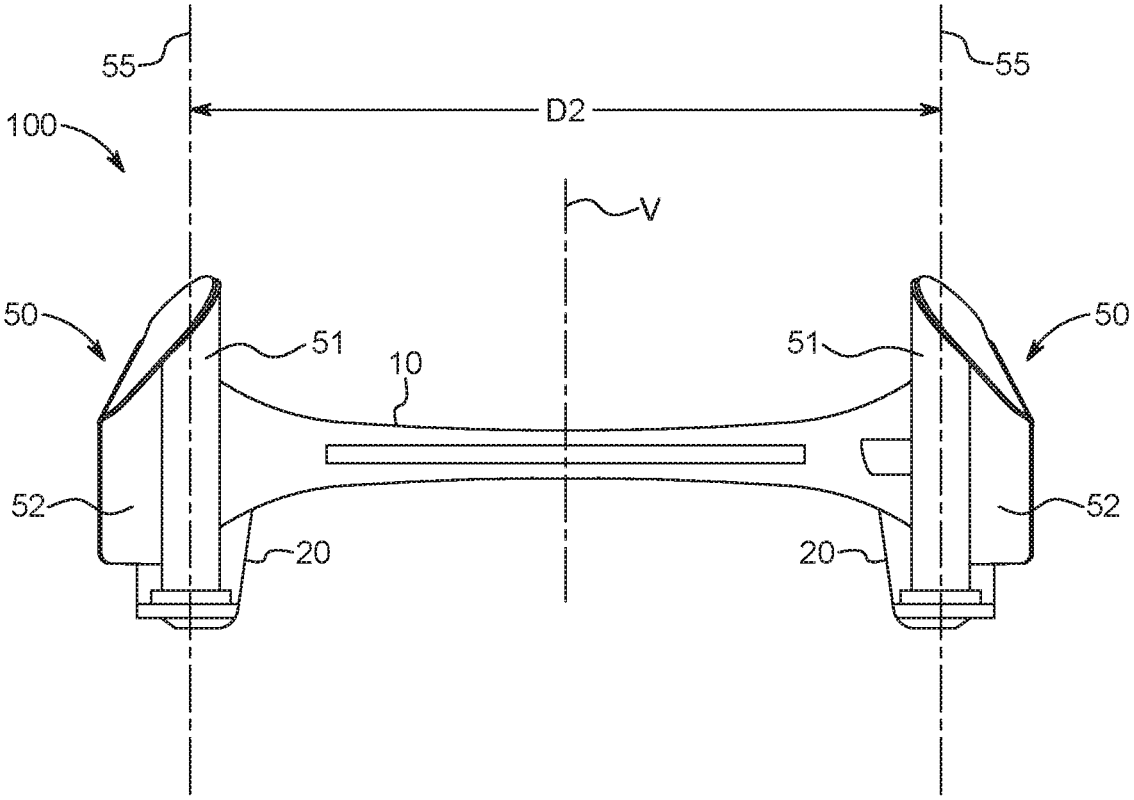
Figure 7A:
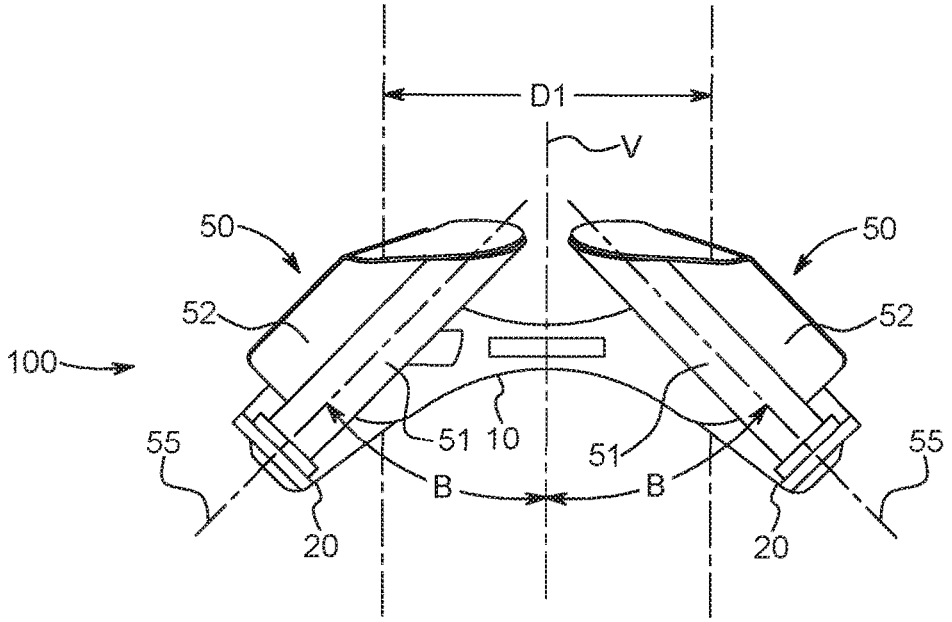
FIGS. 7A-7B are rear views of embodiments of the cable attachment handle of FIG. 1 in a partially pronated grip position.
Figure 7B:
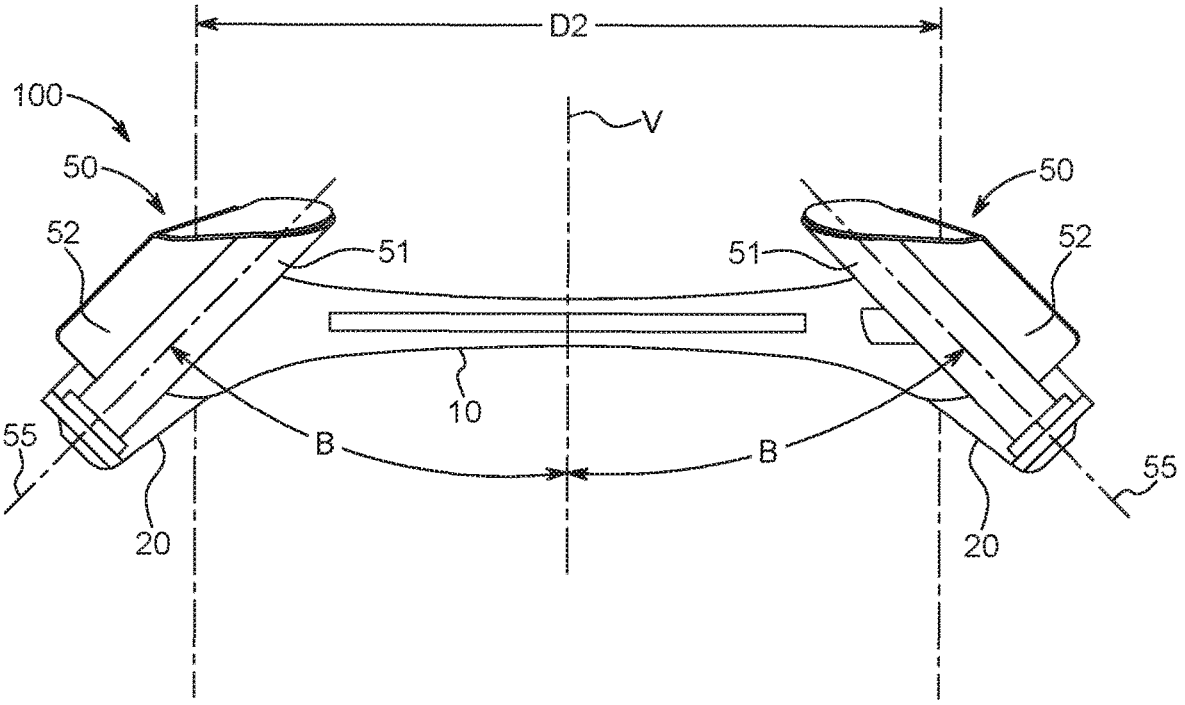

FIGS. 5A-7B also illustrate various lateral spacings of the handle mounts 20 and the handles 50 along the horizontal axis H of the main mounting body 10. FIGS. 5A, 6A, and 7A show a narrow grip configuration in which the studs 11 are spaced apart along the horizontal axis H of the main mounting body 10 by a first distance D1, which may be, for example, 6 inches. FIGS. 5B, 6B, and 7B show a wide grip configuration in which the studs 11 are spaced apart along the horizontal axis H of the main mounting body 10 by a second distance D2, which may be, for example, 14 inches. However, any suitable spacing between the studs 11 may be used, for example, between 6 inches and 28 inches.

Figure 8:
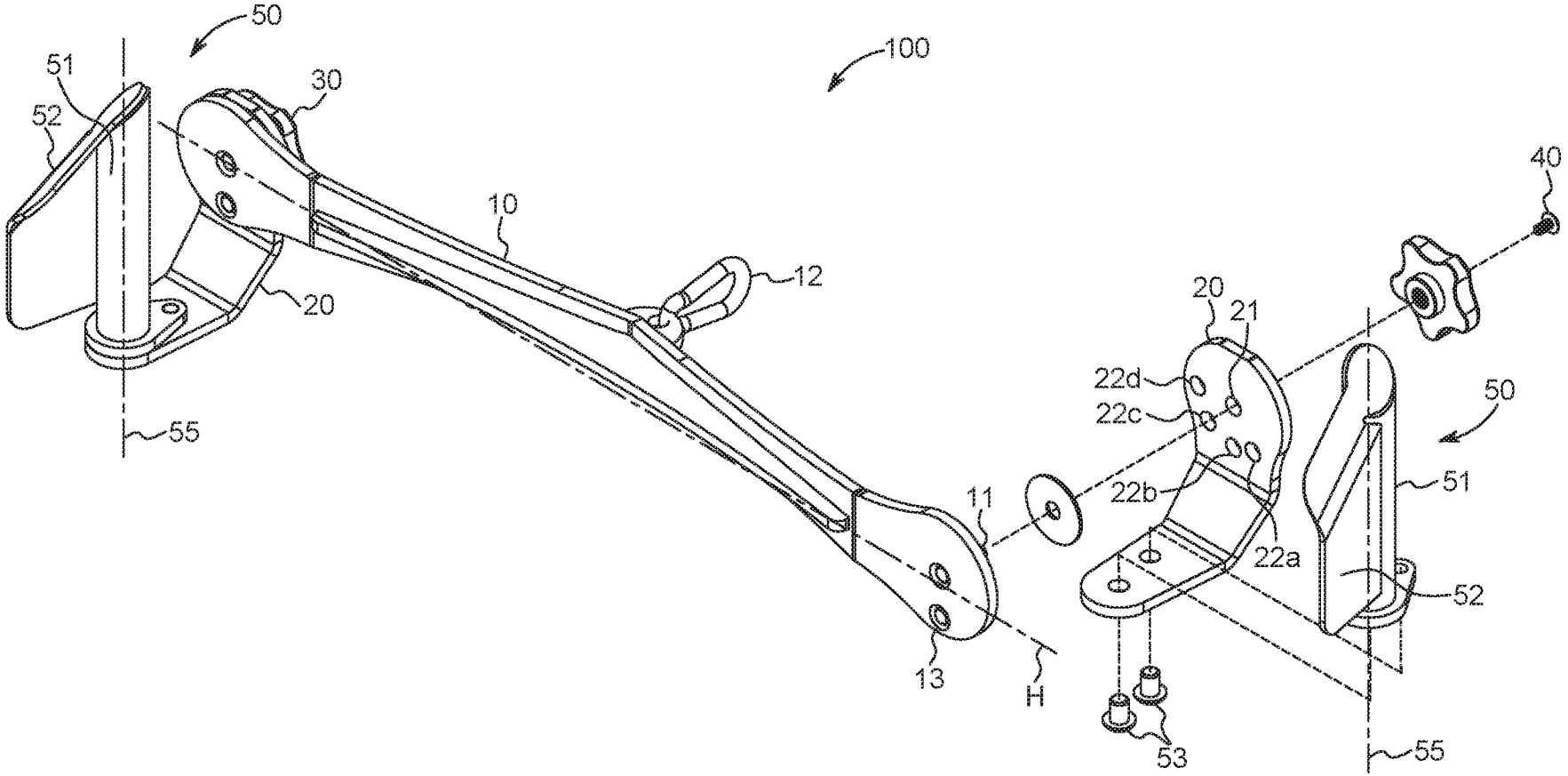
FIG. 8 is an exploded perspective view of a cable attachment handle according to another non-limiting embodiment of the present invention.

While three grip positions, namely partially supinated, neutral, and partially pronated, are respectively shown in FIGS. 2-7B, each handle mount 20 may include additional alignment holes to permit additional grip positions. FIGS. 8-9D show another, non-limiting embodiment of the cable attachment 100 in which each handle mount 20 has four alignment holes 22*a*-22*d* to facilitate rotation of the handle mounts 20 relative to the main mounting body 10 into four grip positions. As the features of the embodiment shown in FIGS. 8-9D are generally similar to the features of the embodiments of FIGS. 1-7B, only the differences will be discussed. As shown in FIG. 8, the four alignment holes 22*a*-22*d* are arranged in an arc, with each of the four alignment holes 22*a*-22*d* equidistant from the stud 11. As with the embodiments of FIG. 1-7B, the handle mounts 20 may be rotated about the stud 11 to align the desired one of the four alignment holes 22*a*-22*d* with the alignment pin 13.

Figure 9A:
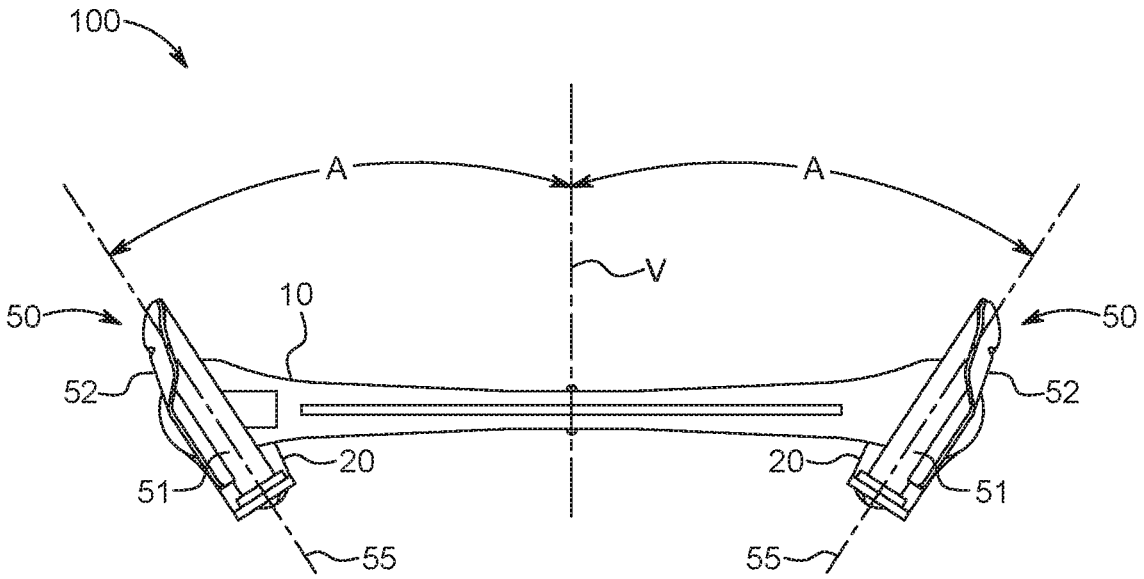
FIG. 9A is a rear view of the embodiment of the cable attachment handle of FIG. 8 in a partially supinated grip position.
Figure 9B:
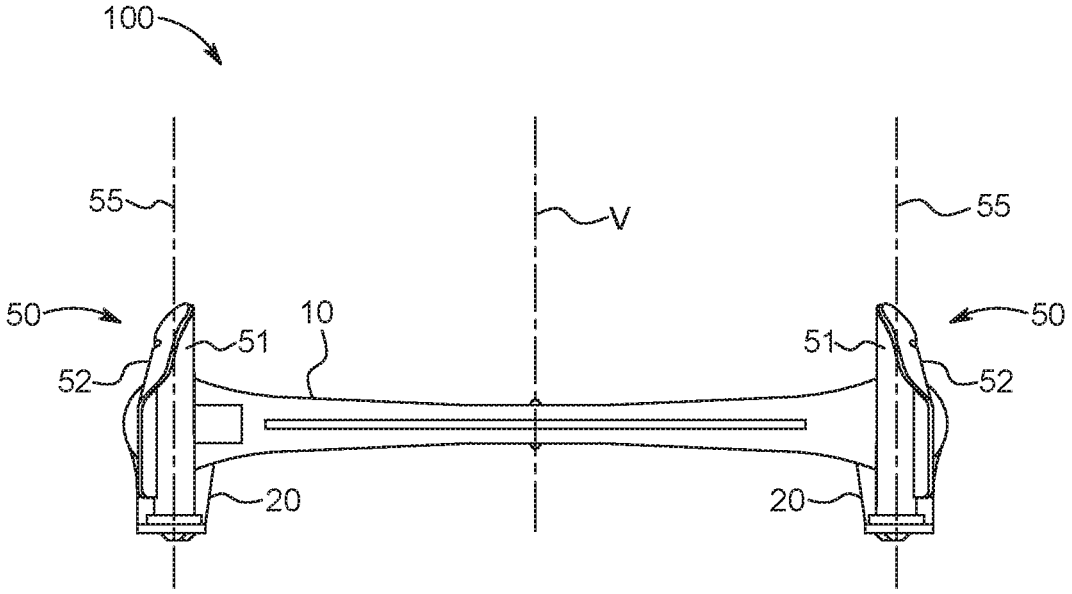
FIG. 9B is a rear view of the embodiment of the cable attachment handle of FIG. 8 in a neutral grip position.
Figure 9C:
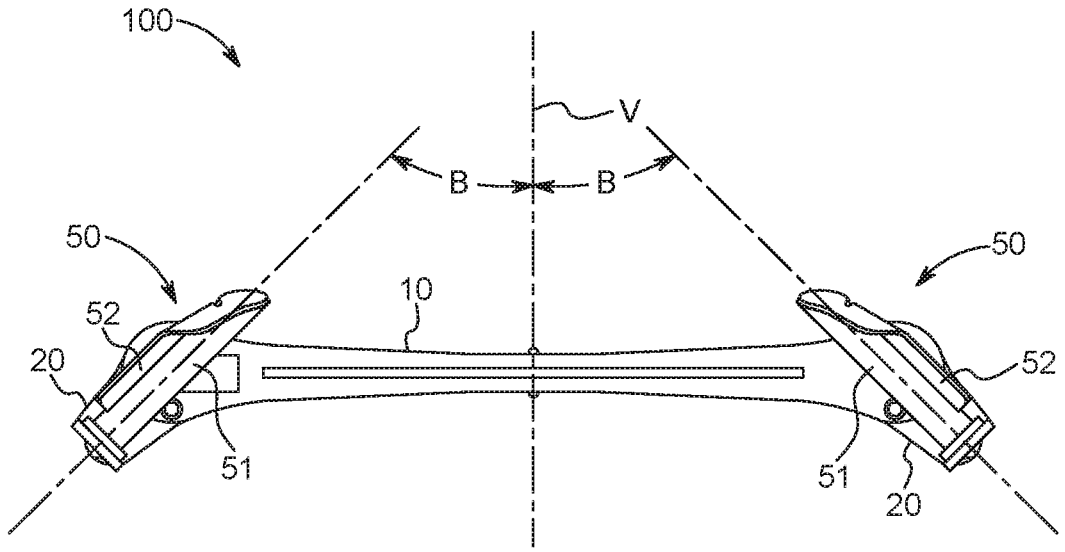
FIG. 9C is a rear view of the embodiment of the cable attachment handle of FIG. 8 in a partially pronated grip position.
Figure 9D:
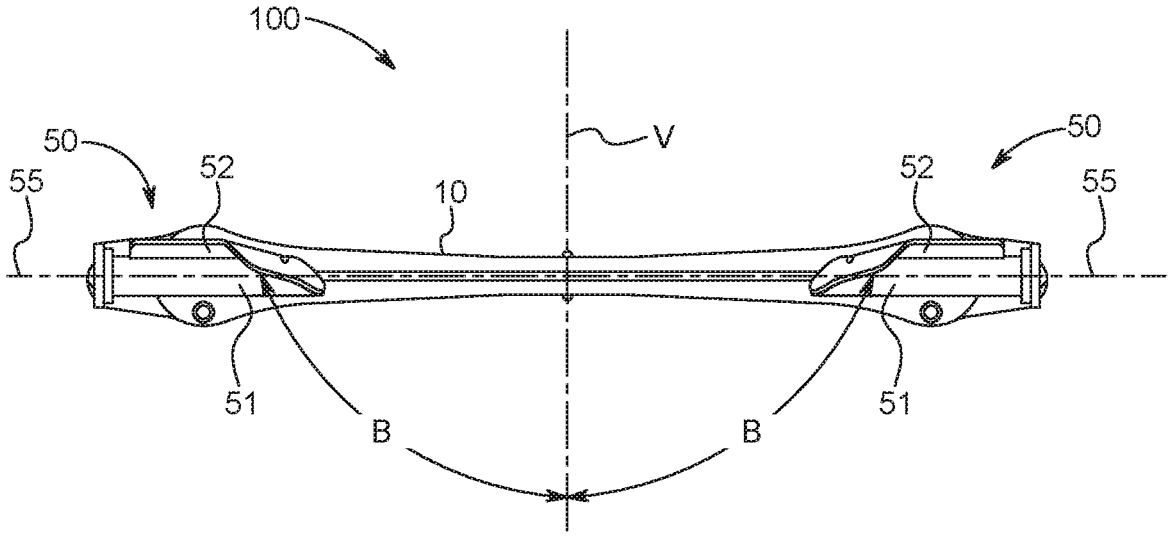
FIG. 9D is a rear view of the embodiment of the cable attachment handle of FIG. 8 in a fully pronated grip position.

FIGS. 9A-9D show the handle mounts 20 arranged in various grip positions corresponding to each of the four alignment holes 22*a*-22*d*. In FIG. 9A, the handle mounts 20 are shown in a partially supinated position, similar to the partially supinated position of FIGS. 5A-5B. The supination angle A of the longitudinal axes 55 of the posts 51 relative to the vertical axis V may be, for example 33°. In the partially supinated position, the alignment pin 13 may be engaged with a first alignment hole 22*a* of the four alignment holes 22*a*-22*d*.

In FIG. 9B, the handle mounts 20 are shown in a neutral position, similar to the neutral position of FIGS. 6A-6B. The longitudinal axes 55 of the posts 51 may be oriented substantially parallel with the vertical axis V. In the neutral position, the alignment pin 13 may be engaged with a second alignment hole 22*a* of the four of alignment holes 22*a*-22*d*.

In FIG. 9C, the handle mounts 20 are shown in a partially pronated position, similar to the partially pronated position of FIGS. 7A-7B. The pronation angle B of the longitudinal axes 55 of the posts 51 relative to the vertical axis V may be, for example 45°. In the partially pronated position, the alignment pin 13 may be engaged with a third alignment hole 22*c* of the four alignment holes 22*a*-22*d*.

In FIG. 9D, the handle mounts 20 are shown in a fully pronated position. The pronation angle B of the longitudinal axes 55 of the posts 51 relative to the vertical axis V may be, for example 90°. In the fully pronated position, the alignment pin 13 may be engaged with a fourth alignment hole 22*d* of the four alignment holes 22*a*-22*d*.

Figure 10A:
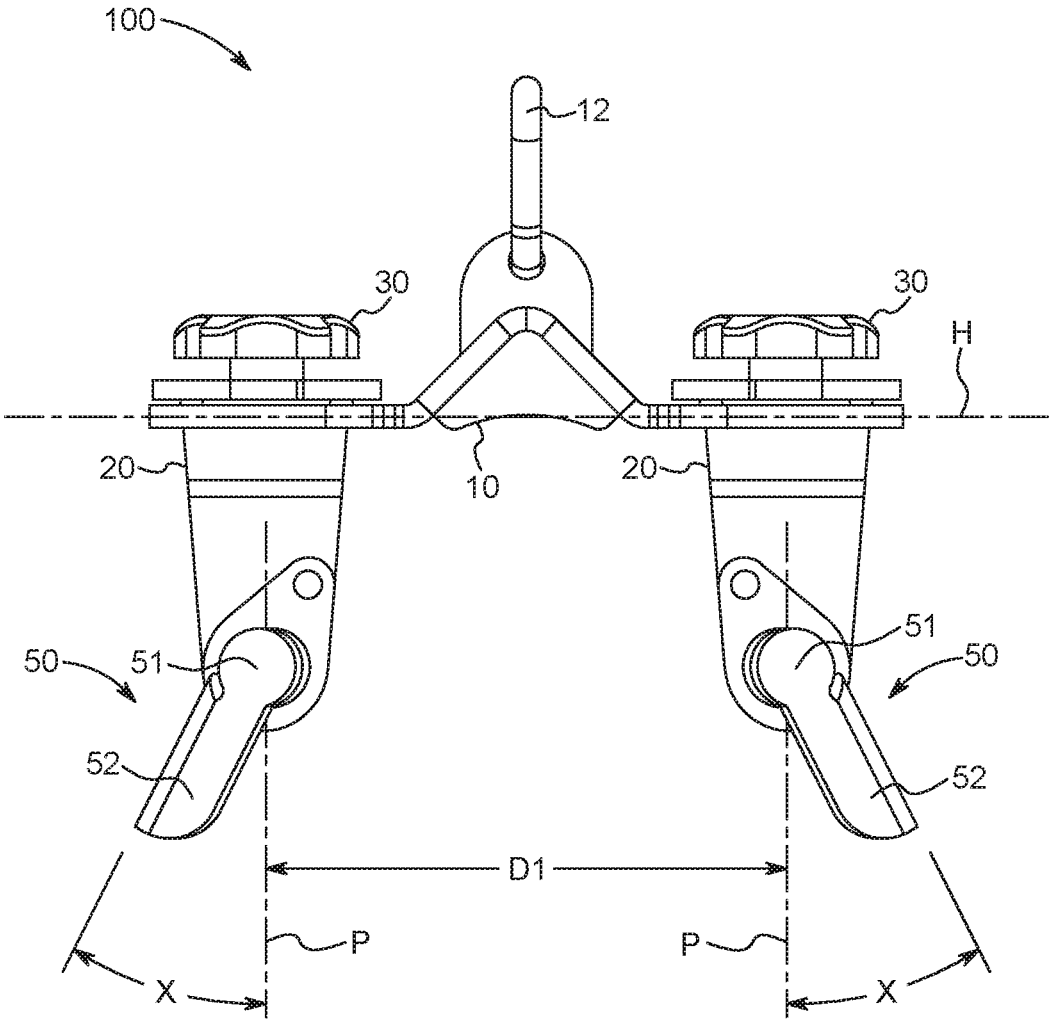
FIG. 10A is a top view of a non-limiting embodiment of the cable attachment handle according to the present invention.
Figure 10B:
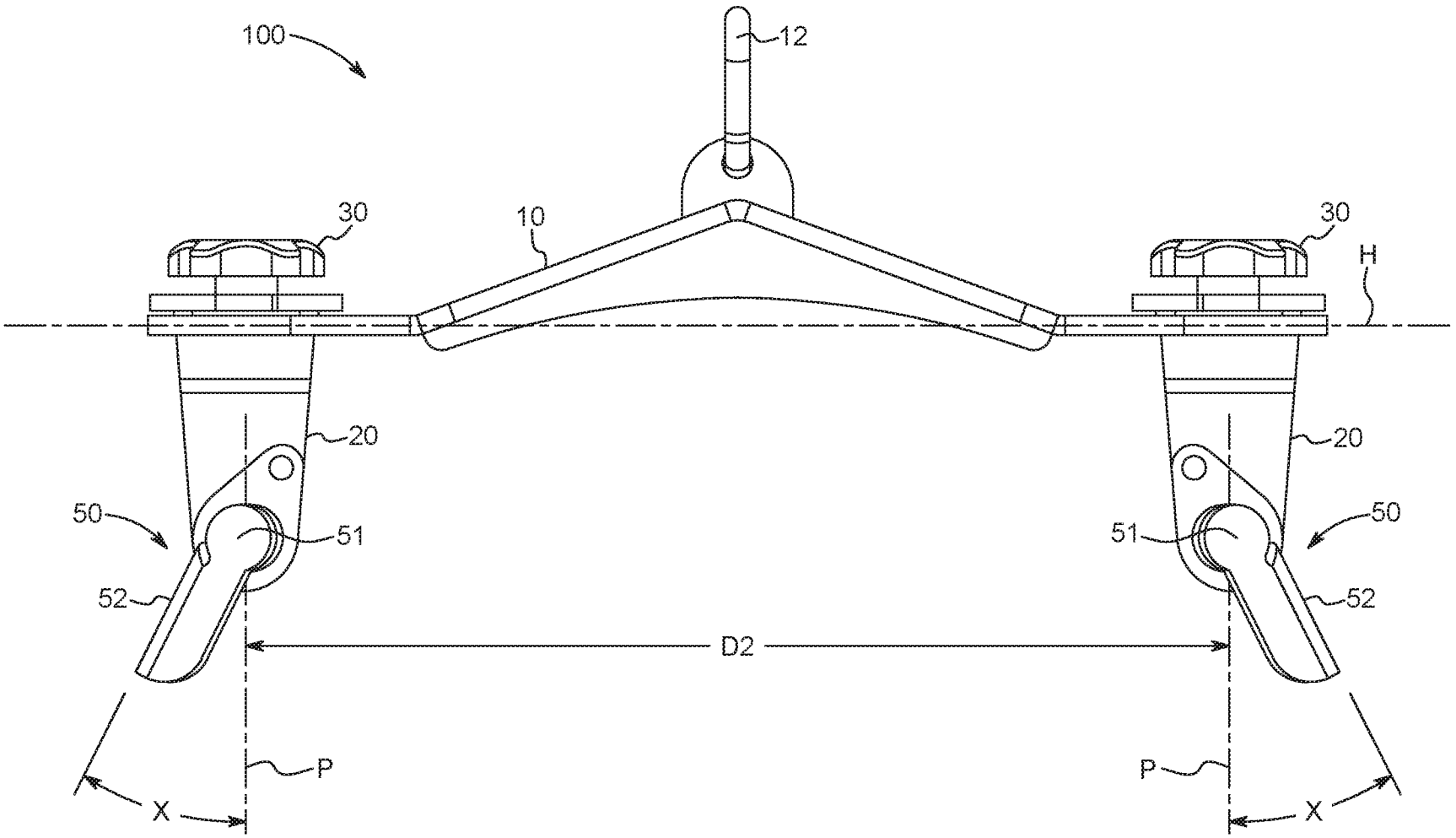
FIG. 10B is a top view of a non-limiting embodiment of the cable attachment handle according to the present invention.
Figure 10C:
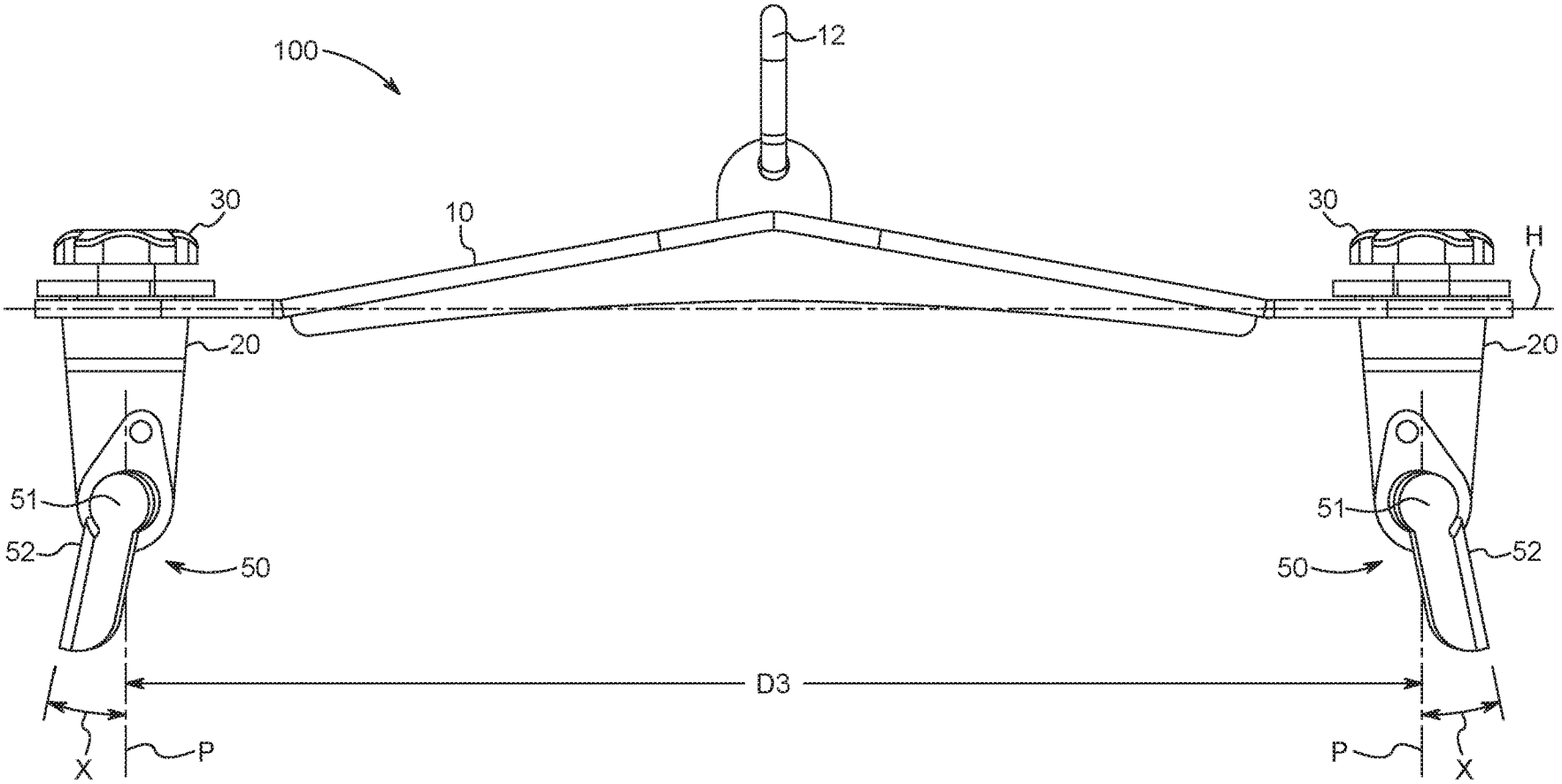
FIG. 10C is a top view of a non-limiting embodiment of the cable attachment handle according to the present invention.

As discussed above with reference to FIGS. 5A-7B, non-limiting embodiments of the cable attachment handle 100 may have a variety of widths, i.e. the distance D1, D2 between the studs 11, for activating different muscle groups and/or for use during different exercise movements. Referring now to FIGS. 10A-10C, embodiments of the cable attachment handle 100 are shown, respectively having a first distance D1 between the studs 11, a second distance D2 between the studs 11, and a third distance D3 between the studs 11. The first distance D1 and the second distance D2 may be, respectively, approximately 6 inches and approximately 14 inches, as discussed above with reference to FIGS. 5A-7B. The third distance D3 may be approximately 20 inches. However, it is to be understood that the distances D1, D2, D3 between the studs 11 in any of the embodiments of the cable attachment handle 100 may be any distance suitable for use with an exercise machine.

With continue reference to FIGS. 10A-10C, the handles 50 of the cable attachment handle 100 may be oriented relative to the handle mounts 20 to achieve a desired wrist flexion angle X between a surface of the paddles 52 and a paddle axis P perpendicular to the horizontal axis H of the main mounting body 10. In FIGS. 10A-10C, the cable attachment handles 100 are shown in the neutral grip position, i.e., with longitudinal axes 55 of the posts 51 extending substantially parallel to the vertical axis V, to best illustrate the wrist flexion angle X. The wrist flexion angle X may be selected to maintain a desired wrist position of the user based on the distance D1, D2, D3 between the studs 11. In particular, the paddles 52 may be oriented such that the flexion angle X induces the user to maintain a straight wrist position, with the user's palms being substantially parallel with the user's forearms. That is, the flexion angle X may be selected to limit flexion and/or extension of the user's wrist. By maintaining a substantially straight wrist position, the user may maximize the biomechanical force exerted on the cable attachment handle 100 and minimize discomfort and risk of injury.

As shown in FIGS. 10A-10C, the flexion angle X necessary to maintain a substantially straight wrist position may be different depending on the distance D1, D2, D3 between the studs 11. Particularly, the greater the distance D1, D2, D3 between the studs 11, the lower the flexion angle X necessary to maintain a substantially straight wrist position. In the embodiments of the cable attachment handle 100 shown in FIGS. 10A and 10B, in which the distances D1, D2 between the studs 11 is approximately 6 inches and approximately 14 inches, respectively, the flexion angle X may be approximately 27°. In the embodiment of the cable attachment handle 100 shown in FIG. 10C, in which the distance D3 between the studs 11 is approximately 20 inches, the flexion angle X may be approximately 12°. In other non-limiting embodiments, the flexion angle X may be between approximately 10° and approximately 30°.

Figure 11:
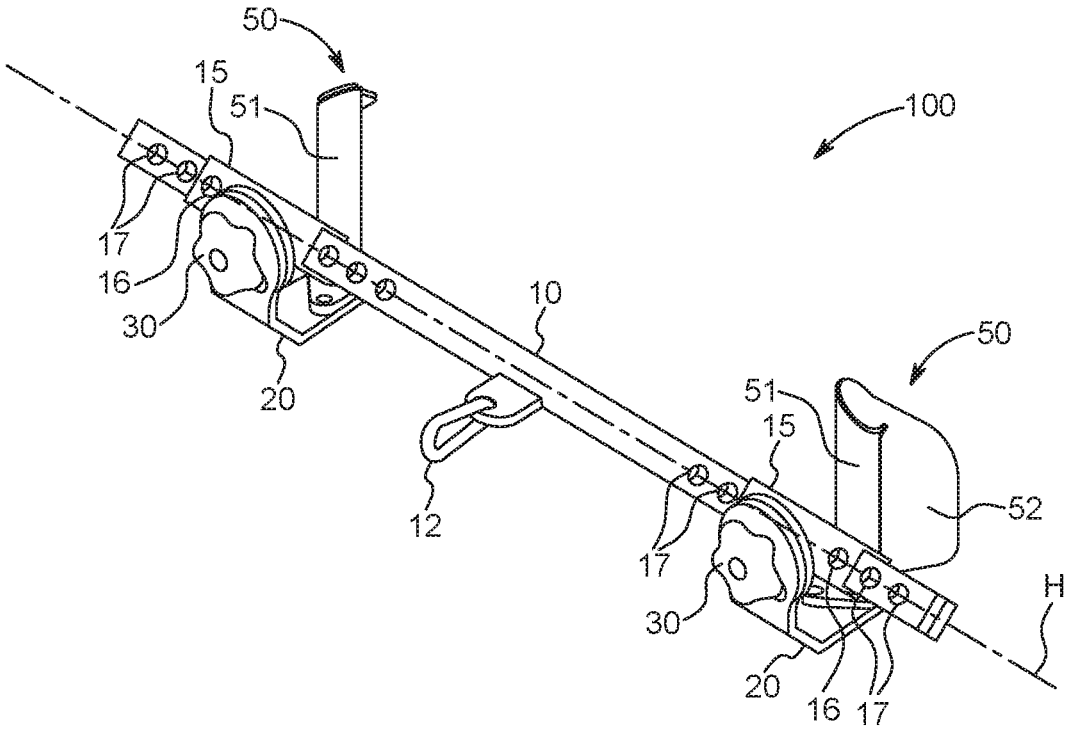
FIG. 11 is a front perspective view of another embodiment of the cable attachment handle according to the present invention.
Figure 12:
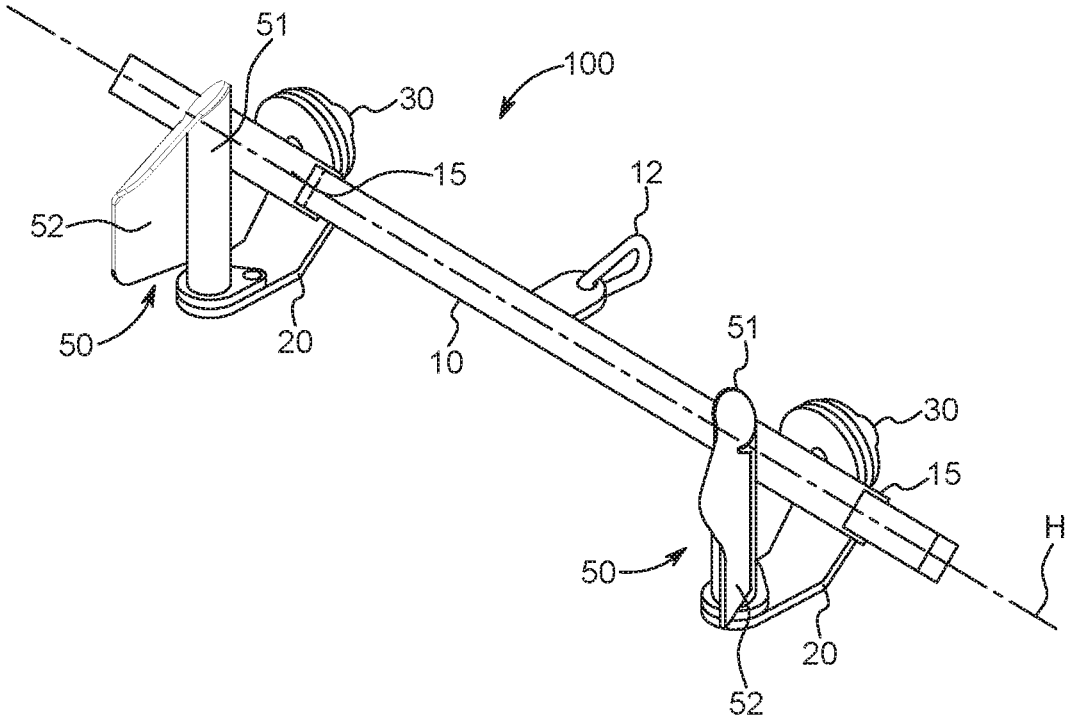
FIG. 12 is a rear perspective view of the cable attachment handle of FIG. 11.

Referring now to FIGS. 11 and 12, some embodiments of the cable attachment handle 100 provide adjustability of the spacing between the handles 50. In such embodiments, the main mounting body 10 includes two slide mounts 15 from which the studs 11 respectively extend. The slide mounts 15 are configured to move along a stationary part of the main mounting body 10 in the direction of the horizontal axis H. The spacing between the handles 50 may be set by the user 200 by moving the slide mounts 15 such that a pin 16 of each slide mount 15 aligns with one of a plurality of indexing holes 17 in the stationary part of the main mounting body 10. The pin 16 of each slide mount 15 may then be inserted into the desired one of a plurality of indexing holes 17 to lock the slide mounts 15 into a set position. The pins 16 may be any suitable structure for laterally securing the slide mounts 15 to one of a plurality of indexing holes 17, such as a spring-loaded popper pin, a cotter pin, or a bolt.

In other embodiments of the cable attachment handle 100 not shown in the drawings, the alignment pins 13 may be located on the handle mounts 20, and the plurality of alignment holes 22*a*-22*c* may be located on the main mounting body 10. Operation and adjustment of the cable attachment handle 100 is otherwise identical to the above-described embodiments. Similarly, in other embodiments of the cable attachment handle 100, the studs 11 may extend from the respective handle mounts 20 through a hole in the main mounting body 10. One skilled in the art may appreciate similar alternative arrangements for the various components, including but not limited to the studs 11, alignment pins 13, and plurality of alignment holes 22*a*-22*d*, which are to be considered within the scope of the present invention.

Figure 13:
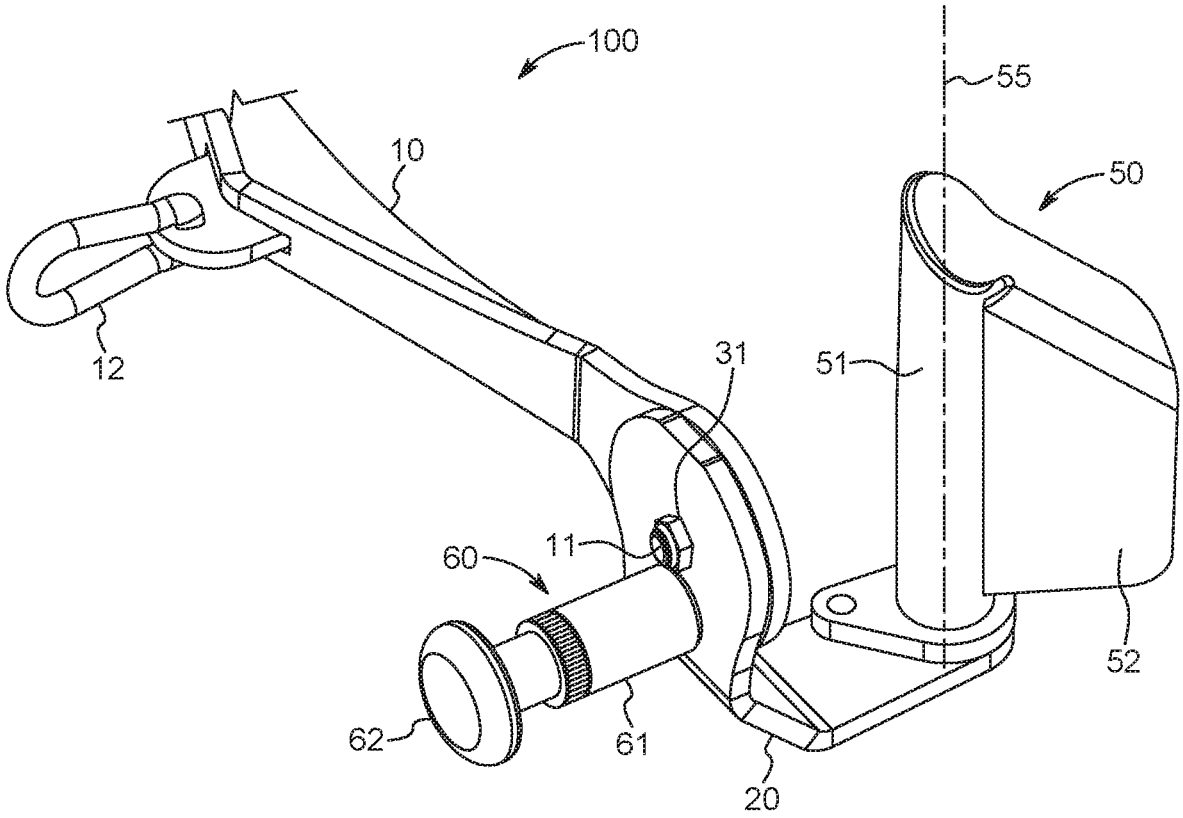
FIG. 13 is a partial perspective view of another embodiment of the cable attachment handle according to the present invention.
Figure 14:
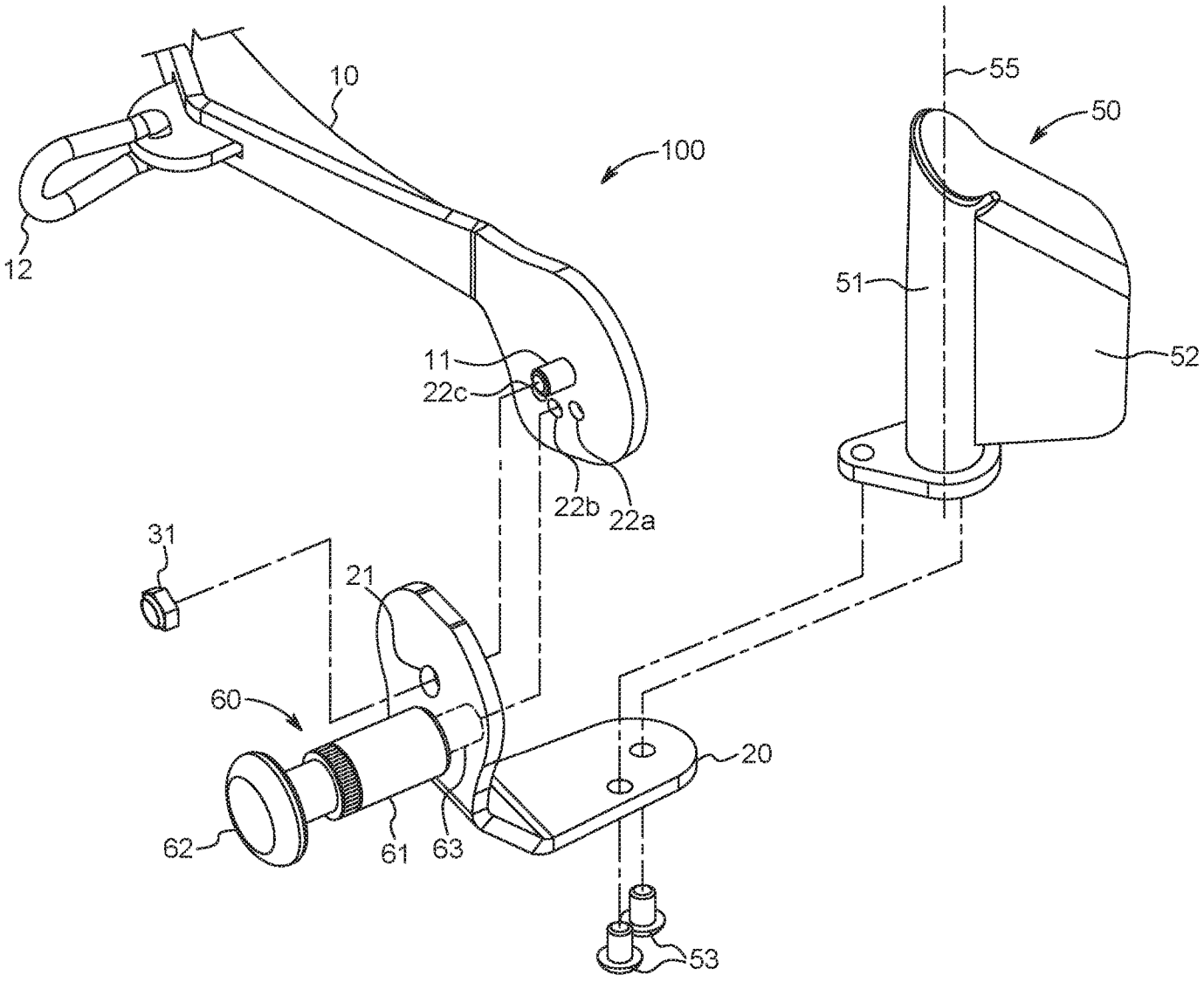
FIG. 14 is a partial exploded perspective view of the cable attachment handle of FIG. 13.

Referring now to FIGS. 13-14, another embodiment of a cable attachment handle 100 of the present disclosure is shown. While FIGS. 13-14 depict only a right-side portion of the cable attachment handle 100 for clarity, those skilled in the art will appreciate that the undepicted left-side portion is substantially a mirror image of the right-side portion. Many of the elements of the embodiment shown in FIGS. 13-14 are identical to those of the previously-described embodiments, as indicated by like reference numerals. Accordingly, only the differences of the embodiment of FIGS. 13-14 will be discussed in detail. In the embodiment of FIGS. 13-14, a nut 31 or other fastener rotatably secures the handle mount 20 to the stud 11 projecting from the main mounting body 10 through the hole 21 of the handle mount 20. The nut 31 or other fastener thus functionally replaces the knob 30 of the other embodiments described herein. As with the other embodiments described above, the arrangement of the stud 11 and nut 31 may be reversed such that the stud 11 projects from the handle mount 20 and the hole 21 is located in the main mounting body 10.

With continued reference to FIGS. 13-14, a popper pin assembly 60 is mounted to the handle mount 20. The popper pin assembly 60 includes a housing 61 rigidly secured to the handle mount 20, a pull knob 62 slideable relative to the housing 61, and a retractable pin 63 extending from the pull knob 62 and projecting toward the main mounting body 10. The pull knob 62 and the retracting pin 63 may be biased toward the main mounting body 10 such that, in a relaxed state, the retracting pin 63 extends through the handle mount 20 and into any one of the plurality of alignment holes 22*a*-22*c*. With the retracting pin 63 extended into any one of the plurality of alignment holes 22*a*-22*c*, the handle mount

20 is rotationally locked relative to the main mounting body 10. The user may free the handle mount 20 from the main mounting body 10 by pulling the pull knob 62 against the bias to displace the retracting pin 63 from the plurality of alignment holes 22*a*-22*c*. The handle mount 20 may then be rotated relative to the main mounting body 10 until the retracting pin 63 aligns with another of the plurality of alignment holes 22*a*-22*c*, at which point the bias of the popper pin assembly 60 will cause the retracting pin 63 to snap into the one of the alignment holes 22*a*-22*c* with which the retracting pin 63 is presently aligned. The handle mount 20 is thus rotationally locked relative to the main mounting body 10.

As may be appreciated from the foregoing description of FIGS. 13-14, the handle mount 20 does not need to be moved apart from the main mounting body 10 along the axis of the stud 11 in order to change the orientation of the handle mount 20. As such, the nut 31 need not be removed or loosened from the stud 11 in order to align the handle mount 20 with a different one of the plurality of alignment holes 22*a*-22*c* in the main mounting body 10.

As will be appreciated by those skilled in the art, the embodiment of FIGS. 13-14 could be modified such that the popper pin assembly 60 is mounted to the main mounting body 10 and the plurality of alignment holes 22*a*-22*c* are located in the handle mount 20. As with all the embodiments described herein, rearrangement of other elements which do not affect the overall functionality of the cable attachment handle 100 may similarly be recognized by those skilled in the art and are considered to fall within the scope of the present disclosure.

While various aspects of the cable attachment handle 100 were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims, and all changes to the invention that fall within the meaning and the range of equivalency of the claims are to be embraced within their scope.

The invention claimed is:

1. A cable attachment handle for an exercise machine comprising:

a main mounting body defining a horizontal axis;

a first stud extending from the main mounting body;

a first handle mount rotatable about the first stud;

a first handle extending from the first handle mount;

a second stud extending from the main mounting body;

a second handle mount rotatable about the second stud;

a second handle extending from the second handle mount;

a cable attachment element affixed to the main mounting body between the first and the second stud;

a first alignment pin extending from the main mounting body and configured to removably engage any of a plurality of alignment holes in the first handle mount; and a second alignment pin extending from the main mounting body and configured to removably engage any of a plurality of alignment holes in the second handle mount, wherein engagement of the first alignment pin with any of the plurality of alignment holes in the first handle mount prevents rotation of the first handle mount and the first handle relative to the main mounting body, and wherein engagement of the second alignment pin with any of the plurality of alignment holes in the second handle mount prevents rotation of the second handle mount and the second handle relative to the main mounting body.

2. The cable attachment handle of claim 1, wherein the first handle and the second handle are adjustable between:

an at least partially supinated position in which the first alignment pin is engaged with a first hole of the plurality of alignment holes in the first handle mount and the second alignment pin is engaged with a first hole of the plurality of alignment holes in the second handle mount;

a neutral position in which the first alignment pin is engaged with a second hole of the plurality of alignment holes in the first handle mount and the second alignment pin is engaged with a second hole of the plurality of alignment holes in the second handle mount; and an at least partially pronated position in which the first alignment pin is engaged with a third hole of the plurality of alignment holes in the first handle mount and the second alignment pin is engaged with a third hole of the plurality of alignment holes in the second handle mount.

3. The cable attachment handle of claim 2, wherein the first handle and the second handle are further adjustable between:

a fully pronated position in which the first alignment pin is engaged with a fourth hole of the plurality of alignment holes in the first handle mount and the second alignment pin is engaged with a fourth hole of the plurality of alignment holes in the second handle mount.

4. The cable attachment handle of claim 1, wherein the first handle extends substantially perpendicular to the first stud, and wherein the second handle extends substantially perpendicular to the second stud.

5. A cable attachment handle for an exercise machine comprising:

a main mounting body defining a horizontal axis;

a first stud extending from the main mounting body;

a first handle mount rotatable about the first stud;

a first handle extending from the first handle mount;

a second stud extending from the main mounting body;

a second handle mount rotatable about the second stud;

a second handle extending from the second handle mount;

a cable attachment element affixed to the main mounting body between the first and the second stud;

a first alignment pin extending from the first handle mount and configured to removably engage any of a first plurality of alignment holes in the main mounting body; and a second alignment pin extending from the second handle mount and configured to removably engage any of a second plurality of alignment holes in the main mounting body, wherein engagement of the first alignment pin with any of the first plurality of alignment holes prevents rotation of the first handle mount and the first handle relative to the main mounting body, and wherein engagement of the second alignment pin with any of the second plurality of alignment holes prevents rotation of the second handle mount and the second handle relative to the main mounting body.

6. The cable attachment handle of claim 1, wherein each of the first handle and the second handle comprise:

a post having a longitudinal axis; and a paddle extending from the post along a plane parallel to a longitudinal axis of the post.

7. The cable attachment handle of claim 6, further comprising one or more fasteners securing each of the first and second handles to each of the first and second handle mounts, respectively.

8. The cable attachment handle of claim 7, wherein the one or more fasteners comprises two or more fasteners spaced apart to prevent rotation of the first and second handles about an axis parallel to the longitudinal axis of the post.

9. The cable attachment handle of claim 5, wherein the first handle and the second handle are adjustable between:

a supinated position in which the first alignment pin is engaged with a first hole of the first plurality of alignment holes in the main mounting body and the second alignment pin is engaged with a first hole of the second plurality of alignment holes in the main mounting body;

a neutral position in which the first alignment pin is engaged with a second hole of the first plurality of alignment holes in the main mounting body and the second alignment pin is engaged with a second hole of the second plurality of alignment holes in the main mounting body; and a pronated position in which the first alignment pin is engaged with a third hole of the first plurality of alignment holes in the main mounting body and the second alignment pin is engaged with a third hole of the second plurality of alignment holes in the main mounting body.

10. The cable attachment handle of claim 9, wherein the first handle and the second handle are further adjustable between:

a fully pronated position in which the first alignment pin is engaged with a fourth hole of the plurality of alignment holes in the first handle mount and the second alignment pin is engaged with a fourth hole of the plurality of alignment holes in the second handle mount.

11. The cable attachment handle of claim 1, wherein each of the first stud and the second stud are slidable along the horizontal axis of the main mounting body.

12. The cable attachment handle of claim 11, wherein each of the first stud and the second stud are lockable at any of a plurality of locations along the horizontal axis of the main mounting body via a popper pin.

13. The cable attachment handle of claim 1, wherein the first handle is removably attached to the first handle mount, and wherein the second handle is removably attached to the second handle mount.

14. The cable attachment handle of claim 6, wherein the paddle extends from the post at an angle of between approximately 10° and approximately 30° relative to a paddle axis perpendicular to the horizontal axis of the main mounting body.

15. A cable attachment handle for an exercise machine comprising:

a main mounting body defining a horizontal axis;

a first handle mount rotatable relative to the main mounting body;

a first handle extending from the first handle mount;

a second handle mount rotatable relative to the main mounting body;

a second handle extending from the second handle mount;

a cable attachment element affixed to the main mounting body;

a first alignment pin extending from the main mounting body and configured to removably engage any of a plurality of alignment holes in the first handle mount; and a second alignment pin extending from the main mounting body and configured to removably engage any of a plurality of alignment holes in the second handle mount, wherein engagement of the first alignment pin with any of the plurality of alignment holes in the first handle mount prevents rotation of the first handle mount and the first handle relative to the main mounting body, and wherein engagement of the second alignment pin with any of the plurality of alignment holes in the second handle mount prevents rotation of the second handle mount and the second handle relative to the main mounting body.

16. The cable attachment handle of claim 15, wherein each of the first handle and the second handle comprises:

a post having a longitudinal axis; and a paddle extending from the post along a plane parallel to a longitudinal axis of the post.

17. The cable attachment handle of claim 16, wherein the paddle extends from the post at an angle of between approximately 10° and approximately 30° relative to a paddle axis perpendicular to the horizontal axis of the main mounting body.

18. The cable attachment handle of claim 15, wherein the first handle and the second handle are adjustable between:

an at least partially supinated position in which the first alignment pin is engaged with a first hole of the plurality of alignment holes in the first handle mount and the second alignment pin is engaged with a first hole of the plurality of alignment holes in the second handle mount;

a neutral position in which the first alignment pin is engaged with a second hole of the plurality of alignment holes in the first handle mount and the second alignment pin is engaged with a second hole of the plurality of alignment holes in the second handle mount; and an at least partially pronated position in which the first alignment pin is engaged with a third hole of the plurality of alignment holes in the first handle mount and the second alignment pin is engaged with a third hole of the plurality of alignment holes in the second handle mount.

* * * * *